US009420931B2

(12) United States Patent
Smith

(10) Patent No.: US 9,420,931 B2
(45) Date of Patent: Aug. 23, 2016

(54) SURFACE TREATING MACHINE

(71) Applicant: Yale Smith, Sausalito, CA (US)

(72) Inventor: Yale Smith, Sausalito, CA (US)

( * ) Notice: Subject to any disclaimer, the term of this patent is extended or adjusted under 35 U.S.C. 154(b) by 0 days.

(21) Appl. No.: 13/852,514

(22) Filed: Mar. 28, 2013

(65) Prior Publication Data

US 2015/0059108 A1 Mar. 5, 2015

(30) Foreign Application Priority Data

Dec. 8, 2010 (WO) ..... PCT/US2010/005934

(51) Int. Cl.
*A47L 11/284* (2006.01)
*A47L 11/40* (2006.01)

(52) U.S. Cl.
CPC ..... *A47L 11/4069* (2013.01); *A47L 11/284* (2013.01)

(58) Field of Classification Search
CPC ... A47L 11/12; A47L 11/4069; A47L 11/284; A47L 11/4036; A47L 11/24; A47L 11/28
See application file for complete search history.

(56) References Cited

U.S. PATENT DOCUMENTS 8,341,793 B2 * 1/2013 Walker ..... A63D 5/10 15/49.1

* cited by examiner

*Primary Examiner* — Shay Karls
(74) *Attorney, Agent, or Firm* — David E. Lovejoy

(57) ABSTRACT

A machine for treating a surface lying in an XY-plane comprising a body, a body plate attached to the body, a drive assembly attached to the body and a cleaning plate assembly. The drive assembly includes a motor having a motor drive shaft and a transmission having offset drivers driven by the motor drive shaft. The cleaning plate assembly has an eccentric drive member engaging the offset drivers to drive the cleaning plate assembly in an oscillating pattern parallel to the XY-plane and relative to the body plate.

10 Claims, 16 Drawing Sheets

FIG. 14
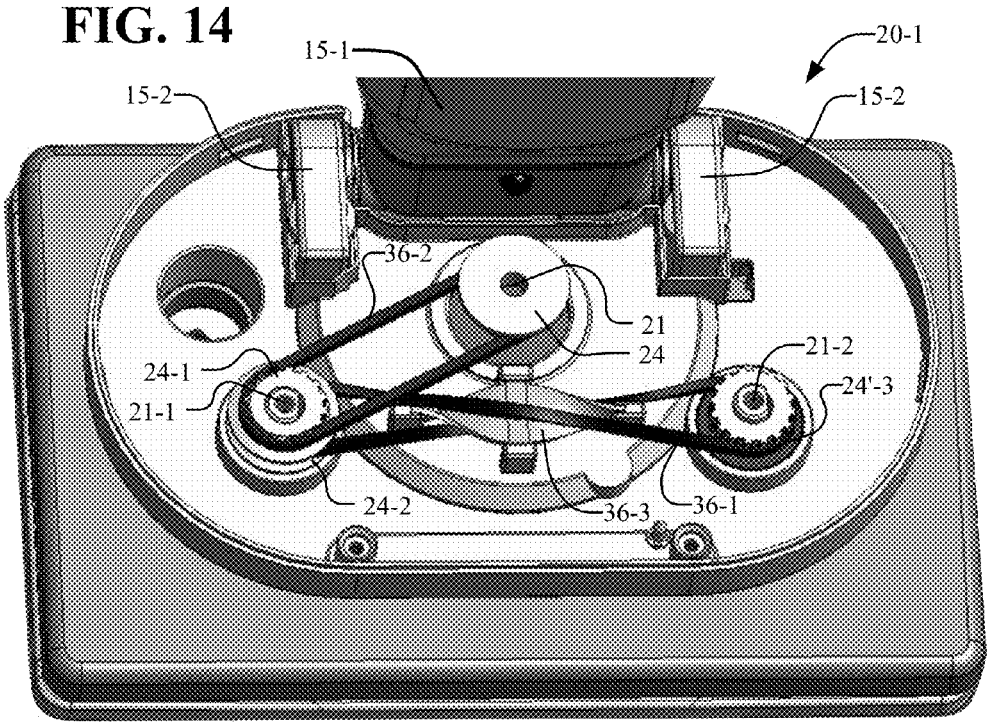
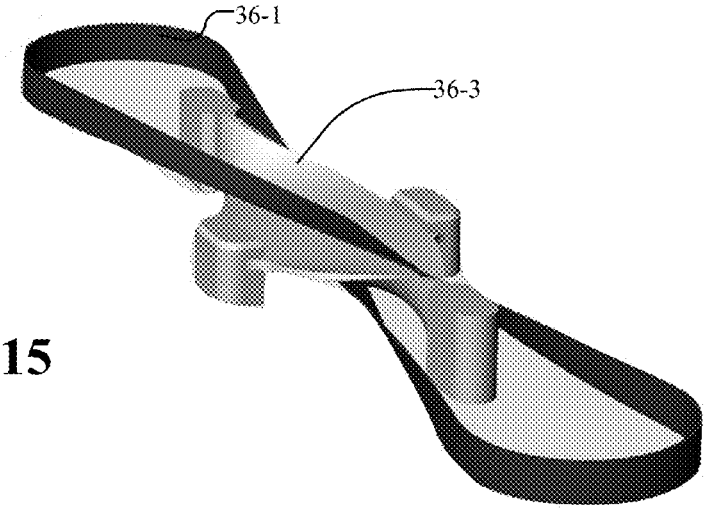
FIG. 15

FIG. 36
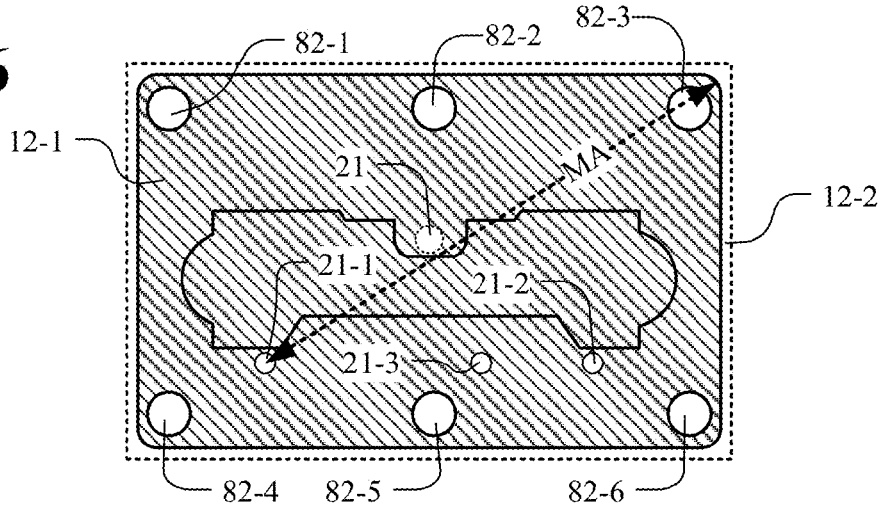
FIG. 37
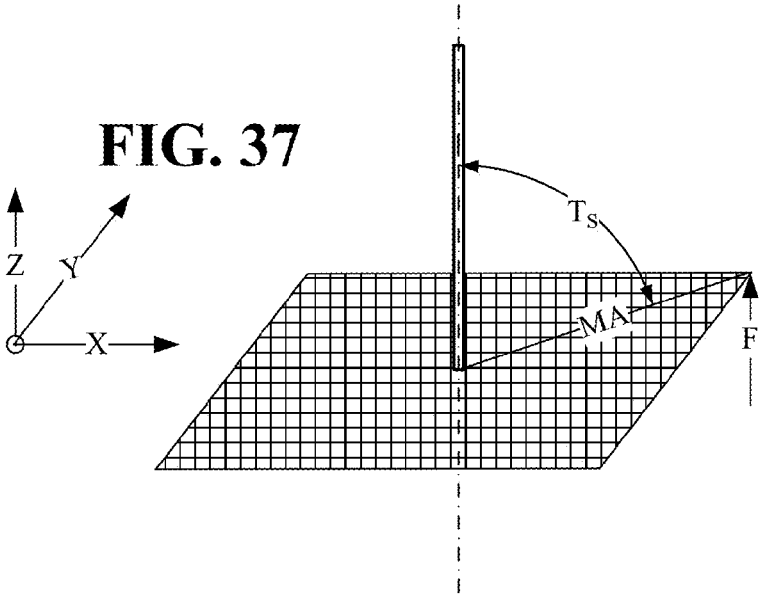
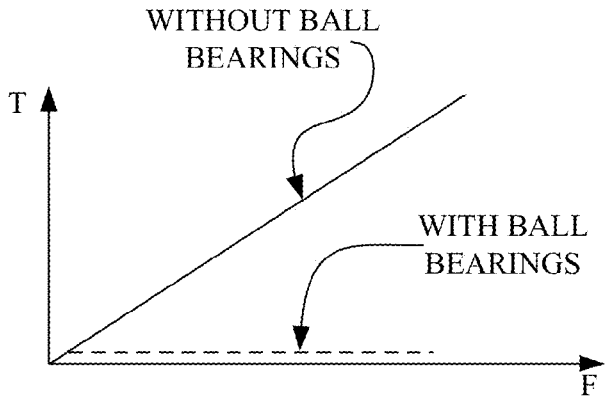
FIG. 38

SURFACE TREATING MACHINE

BACKGROUND OF THE INVENTION

This invention relates to a machine for treating work surfaces such as floors formed of carpet, tile, wood and other materials. The most efficient and effective surface treatments employ a vibration, "scrubbing", motion to loosen materials on the work surface. On floors and other work surfaces, a machine typically uses a cleaning towel, "pad", in combination with a solvent, including water or steam, and/or a cleaning agent. When the cleaning towel scrubs the floor and becomes dirty, the towel is replaced with a clean one.

In U.S. Patent publication 20070107150 A1 having inventor Yale Smith and published May 17, 2007, a Carpet Cleaning Apparatus And Method With Vibration, Heat, And Cleaning Agent is described. In that patent publication, a combination of vibratory motion, controllable heat, and cleaning agents are used. The apparatus includes a base cleaning plate, heating elements with electrical connections, and means for moving the cleaning plate to produce a scrubbing motion.

Important attributes of surface treating machines are cleaning effectiveness, ease of use, convenience, stability, light weight, low machine wear, long life and ease of maintenance. These attributes are import for machines used by professionals in heavy duty environments or used by other consumers in home or other light duty environments.

Cleaning effectiveness requires that machines include a small oscillation that creates a local vibration in a cleaning plate to impart a "scrubbing" movement to the surface being treated. For cleaning floors, the local vibration is preferably in a range of several millimeters. Cleaning effectiveness and convenience requires that the shape of the cleaning plate be rectangular so as to be readily used along straight edges and easily moved into rectangular corners. In order to satisfy these attributes, machines with round bottom plates are undesirable.

Ease of use and convenience require stability, appropriate size and weight and ease of operator control. Designs that position the motor and drive assembly high above the cleaning plate are undesirable since such configurations tend to accentuate vertical instability. Vertical instability results in unwanted oscillation of the cleaning plate up and down in a mode that is in and out of the plane of the work surface. The plane of the work surface is referred to as the floor surface plane or the XY-plane. Vertical instability is distinguished from horizontal oscillations providing local vibration to impart a "scrubbing" movement to the cleaning plate. The horizontal oscillations are parallel to the plane of the work surface, that is, parallel to the XY-plane. Vertical instability is additionally undesirable because it uses excessive amounts of energy, reduces the energy efficiency of the machine and causes increased wear on the motor, the dive shafts, the drivers and the drive bushings. The increased wear increases maintenance and decreases the life of the machine. User fatigue is dramatic when unwanted vertical oscillations occur.

High energy efficiency is an important attribute. For machines powered by an AC electrical service through an AC-to-DC converter or powered by a battery, the size and cost of the motor is a function of the energy requirements needed to drive the transmission and the cleaning plate. For DC motors, the energy requirements are important for the motor and for the AC-to DC converter used to convert the AC electrical service to DC. The more energy efficient the machines, the smaller and less expensive are the AC-to-DC converters, batteries and motors required to power the machines.

Another factor in cleaning effectiveness is determined by the material of the machine in contact with the floor material. Brushes are not absorbent and therefore are inefficient in removing solid and liquid matter from a floor. For existing machines that use a towel, the towels are typically synthetic and do not absorb and hold solid and liquid matter from a floor. For towels that are primarily cotton, they have the disadvantage of not scrubbing well and also have high friction with the floor surface resulting in low energy efficiency.

In light of the above background, it is desirable to have improved surface treatment machines for treating carpets, tiles, wood and other surface materials.

SUMMARY

The present invention is a machine for treating a surface lying in an XY-plane comprising a body, a body plate attached to the body, a drive assembly attached to the body and a cleaning plate assembly. The drive assembly includes a motor having a motor drive shaft and a transmission having offset drivers driven by the motor drive shaft. The cleaning plate assembly has an eccentric drive member engaging the offset drivers to drive the cleaning plate assembly in an oscillating pattern parallel to the XY-plane and relative to the body plate.

In embodiments, the motor drive shaft extends in a direction normal to the XY-plane, and the transmission connects from the motor drive shaft to the eccentric drive member of the cleaning plate assembly with belts and gears.

In embodiments, the motor drive shaft extends in a direction parallel to the XY-plane, and the transmission connects from the motor drive shaft to the eccentric drive member of the cleaning plate assembly.

In embodiments, the present invention is a machine for treating a surface lying in an XY-plane comprising a body, a body plate attached to the body, a drive assembly attached to the body, a cleaning plate assembly and one or more ball bearings positioned between the body plate and the cleaning plate for separating the body plate and the cleaning plate. The drive assembly includes a motor having a motor drive shaft and a transmission having offset drivers driven by the motor drive shaft. The cleaning plate assembly has an eccentric drive member engaging the offset drivers to drive the cleaning plate assembly in an oscillating pattern parallel to the XY-plane and relative to the body plate.

In embodiments, the body plate and the cleaning plate each have pockets near edges for receiving the ball bearings whereby the ball bearings roll in the pockets during movement of the cleaning plate in the oscillating pattern. In embodiments, the pockets have side walls and the side walls lined with soft material for suppressing noise when the ball bearings roll in the pockets during movement of the cleaning plate. In embodiments, one or more of the pockets is lined with a compressible soft material whereby the ball bearings are maintained in contact with both the body plate and the cleaning plate. In embodiments, the offset drivers each have a driver offset measured from a center axis of the respective offset driver drive shaft whereby the cleaning plate assembly is constrained to move in a treatment region bounded by approximately +/− the driver offset where the driver offset is typically between 4 and 10 mm.

In embodiments, the present invention is a machine for treating a surface lying in an XY-plane comprising a body, a body plate attached to the body, a drive assembly attached to the body, a cleaning plate assembly and one or more ball bearings positioned between the body plate and the cleaning plate for separating the body plate and the cleaning plate. The cleaning plate assembly has a convex shape for driving the machine in a forward direction. The drive assembly includes a motor having a motor drive shaft and a transmission having offset drivers driven by the motor drive shaft. The cleaning plate assembly has an eccentric drive member engaging the offset drivers to drive the cleaning plate assembly in an oscillating pattern parallel to the XY-plane and relative to the body plate. In embodiments, the cleaning plate and an eccentric drive member are engaged by force toward the center of the eccentric drive member to draw the cleaning plate into the convex shape.

The foregoing and other objects, features and advantages of the invention will be apparent from the following detailed description in conjunction with the drawings.

BRIEF DESCRIPTION OF THE DRAWINGS

FIG. 14 depicts an isometric view of the transmission of FIG. 12.

FIG. 15 depicts an isometric view of the reversing belt in the transmission in FIG. 14.

FIG. 36 depicts a view of the cleaning plate over a cleaning pad.

FIG. 37 depicts a simplified representation of the geometry of the cleaning plate.

FIG. 38 depicts a graphical representation of the forces being created by the cleaning plate and the torque on the drive assembly.

DETAILED DESCRIPTION

Figure 1:
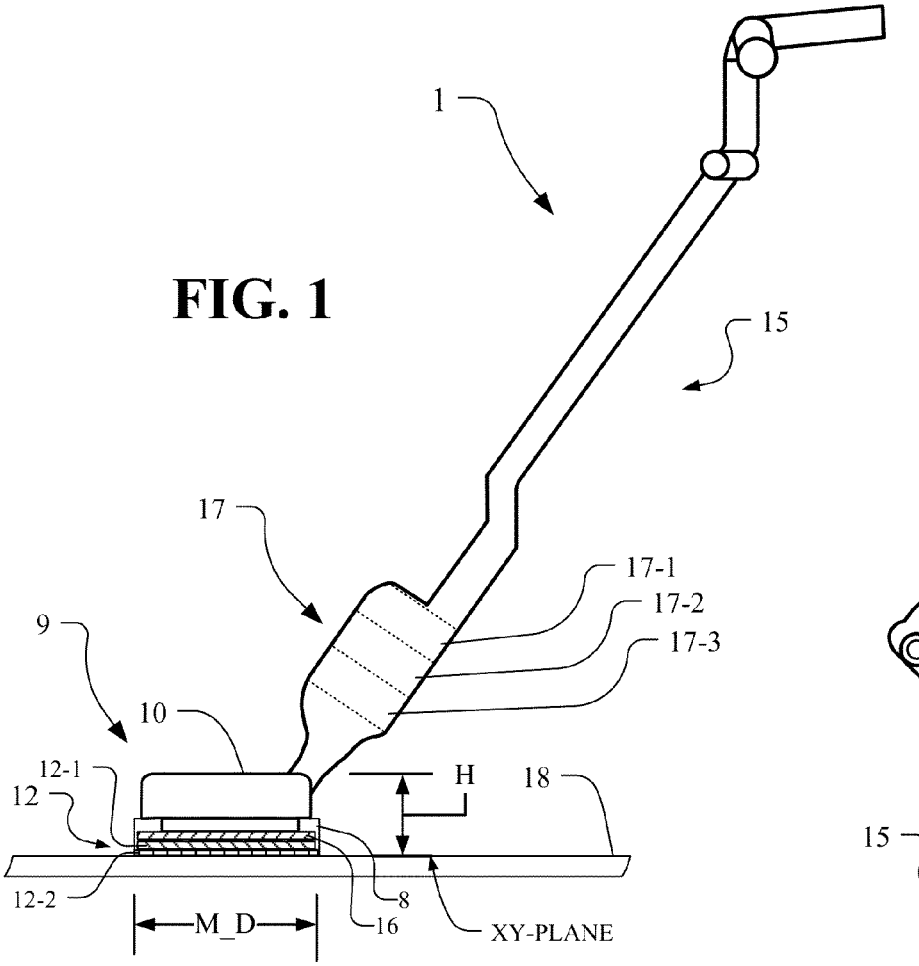
FIG. 1 depicts a side view of one embodiment of a surface treating machine on a surface to be treated.

In FIG. 1, a surface treating machine 1 includes a body 9, a drive assembly 10 and a cleaning plate assembly 12. A body plate 16 is rigidly attached to the body 9. The cleaning plate assembly 12 is driven by the drive assembly 10 for cleaning or polishing the floor surface lying in a floor plane denominated as the XY-plane. The cleaning plate assembly 12 includes a cleaning plate 12-1 and a cleaning pad 12-2. In some embodiments, the machine 1 includes a skirt 8 attached as part of the body 9 and superimposed over the cleaning plate assembly 12.

In FIG. 1, the machine 1 includes a handle assembly 15 affixed to the body 9 for enabling a user to guide machine 1 over a floor surface lying in the XY-plane. The handle assembly 15 has a length extending from the body 9 at a variable angle with the XY-plane. One or more compartments 17 are attached to or the handle assembly 15. The compartments include, for example, one or more fluid compartments 17-1 for storing water, cleaners or other solutions and one or more electrical compartments for housing an AC-to-DC converter 17-2 or a battery 17-3. The handle assembly may include items not explicitly shown such as an AC power cord, a power plug for operation with an AC-to-DC converter, an electrical control line and an ON/OFF switch. The handle assembly 15 is rotationally attached to body 9 and adjusts to acute angles with the cleaning surface when in use for cleaning. The handle assembly 15 includes a latch for latching the handle assembly 15 in the vertical position for transport and storage of the machine 1 when not in operation.

The drive assembly 10 has a drive assembly height dimension, H, measured from the XY-plane. The cleaning plate assembly 12 typically has a length and a width lying in the XY-plane of the floor surface. The smaller one of the length and the width dimensions, or the only dimension if the length and width are equal, of the cleaning plate assembly 12 is the minimum treatment dimension, M_D. In order to provide stability for the machine 1, the height dimension, H, typically is less than one half of the minimum treatment dimension, M_D. A low drive assembly height dimension is important in minimizing or preventing unwanted vertical instability. Vertical instability results in unwanted oscillation of the cleaning plate up and down in a mode that is in and out of the XY-plane of the work surface. Such unwanted oscillations are a complex function of the floor surface material and movements of the machine during operation as well as the design of the machine. For normal and intended operation, the machine is operating with oscillations in the XY-plane of the floor surface. When the machine is moved from location to location on a floor by a machine operator, some forces out of the XY-plane inherently result. If the drive assembly 10 height dimension, H, is too high, these forces out of the XY-plane tend to accumulate in intensity reaching a resonant vibration frequency identified as vertical instability. Such vertical instability can be difficult to control by an operator and is wasteful of energy. In some embodiments, the vertical instability is minimized or eliminated by having the drive assembly height dimension, H, less than one half of the minimum treatment dimension, M_D.

Figure 2:
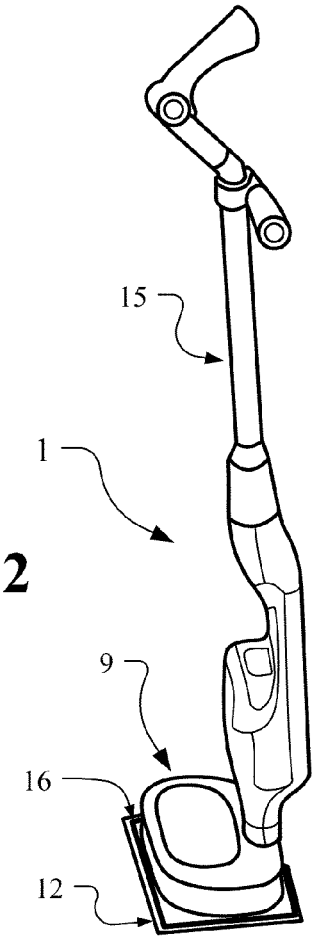
FIG. 2 depicts an isometric view of the surface treating machine of FIG. 1.

In FIG. 2, an isometric view of the surface treating machine 1 of FIG. 1 is shown. The surface treating machine 1 includes a body 9 with a handle assembly 15. The handle assembly 15 is shown latched in the upright position. The cleaning plate assembly 12 is driven by the body 9 in an oscillating pattern.

Figure 3:
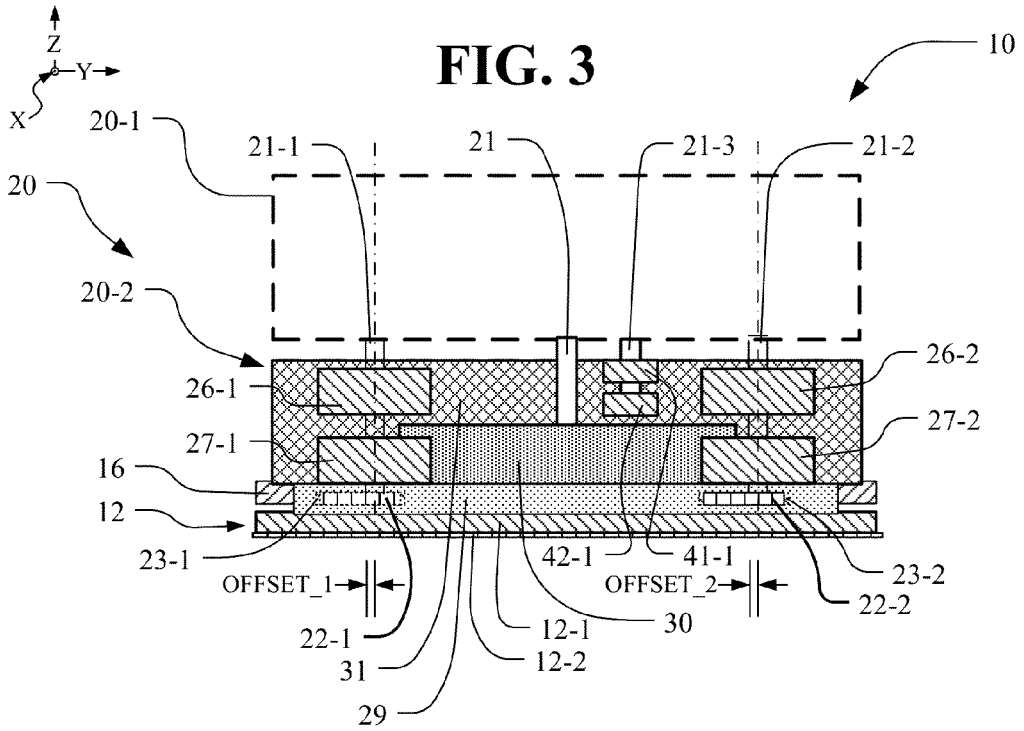
FIG. 3 depicts a front view with further details of one embodiment of the drivers and the cleaning plate assembly of the machine of FIG. 1.

In FIG. 3, a front view with further details of one embodiment of the drive assembly 10, the body plate 16 and the cleaning plate assembly 12 of FIG. 1 is shown. The drive assembly 10 includes a motor 30 and a transmission 20. The transmission 20 includes a first transmission assembly part 20-1 and a second transmission assembly part 20-2. The first transmission assembly part 20-1 connects to the second transmission assembly part 20-2 through a motor drive shaft 21, a first drive shaft 21-1, and a second drive shaft 21-2 and a third drive shaft 21-3. In the second transmission assembly part 20-2, a base 31 supports the motor 30 and the first drive shaft 21-1, the second drive shaft 21-2 and the third drive shaft 21-3.

The first drive shaft 21-1 is supported by first bearings 26-1 and 27-1 in the base 31 which connects to a first offset driver 22-1. A first bushing 23-1 engages the first offset driver 22-1. The second drive shaft 21-2 is supported by second bearings 26-2 and 27-2 in the base 31 which connects to a second offset driver 22-2. A second bushing 23-2 engages the second offset driver 22-2. The first bushing 23-1 and the second bushing 23-2 are mounted in the eccentric drive member 29. The first offset driver 22-1 and the second offset driver 22-2 rotate in first bushing 23-1 and the second bushing 23-2, respectively. Because the first offset driver 22-1 and the second offset driver 22-2 have offsets from the center lines of drive shafts 21-1 and 21-2, the eccentric drive member 29 oscillates within an opening in the body plate 16. In some embodiments, a drive shaft 21-3 is supported by bearings 41-1 and 42-1 in the base 31.

The transmission first assembly part 20-1 operates to transfer the rotational motion of the drive shaft 21 to the drive shafts 21-1 and 21-2 and thereby to the offset drivers 22-1 and 22-2. The offset drivers 22-1 and 22-2 drive the cleaning plate assembly 12 in a vibrating motion in the XY-plane by a ±OFFSET_D. The offset driver 22-1 has an OFFSET_1 offset from the center axis of the drive shaft 21-1 by the offset OFFSET_1 that is equal to OFFSET_D. The offset driver 22-2 has an OFFSET_2 offset from the center axis of the drive shaft 21-2 by the offset OFFSET_2 that is equal to OFFSET_D. The offset drivers 22-1 and 22-2 each have a driver offset, equal to OFFSET_D, measured from a center axis of the respective offset driver drive shaft whereby the cleaning plate assembly 12 is constrained to move in a treatment region bounded by approximately +/− the driver offset.

In FIG. 3, the motor drive shaft 21 and portions of the transmission 20 are located with the motor drive shaft 21 extending in the +Z-axis direction, a direction away from and normal to the XY-plane. The transmission 20 connects from the motor drive shaft 21 around the motor 30 to the bushings 23-1 and 23-2 in the eccentric drive member 29. The positioning of portions of the transmission 20 above the motor 30 and away from the XY-plane of the floor surface is desirable in that it enables ready and easy access for repair or other servicing and keeps those portions of the transmission 20 away from the potentially wet or dirty cleaning environment of the floor surface at the XY-plane.

In FIG. 3, the motor 30 in one embodiment is a pancake shaped printed motor that is compact in size, high in output torque, high in energy efficiency, 75%-85%, high in reliability and low in noise using rare earth magnets and operable in voltages from 12 volts to 48 volts. Such motors are sold, for example, by Golden Motors of Shanghai, China. The DC motors have a higher starting torque than AC motors. The low DC voltages provide good user safety and are battery capable. In one embodiment described, the motor 30 has a no-load operation at 3200 RPM which is reduced by the transmission to 2000 RPM. In another embodiment, the motor 30 has a no-load operation at 2880 RPM which is reduced by the transmission to 1800 RPM.

Figure 4:
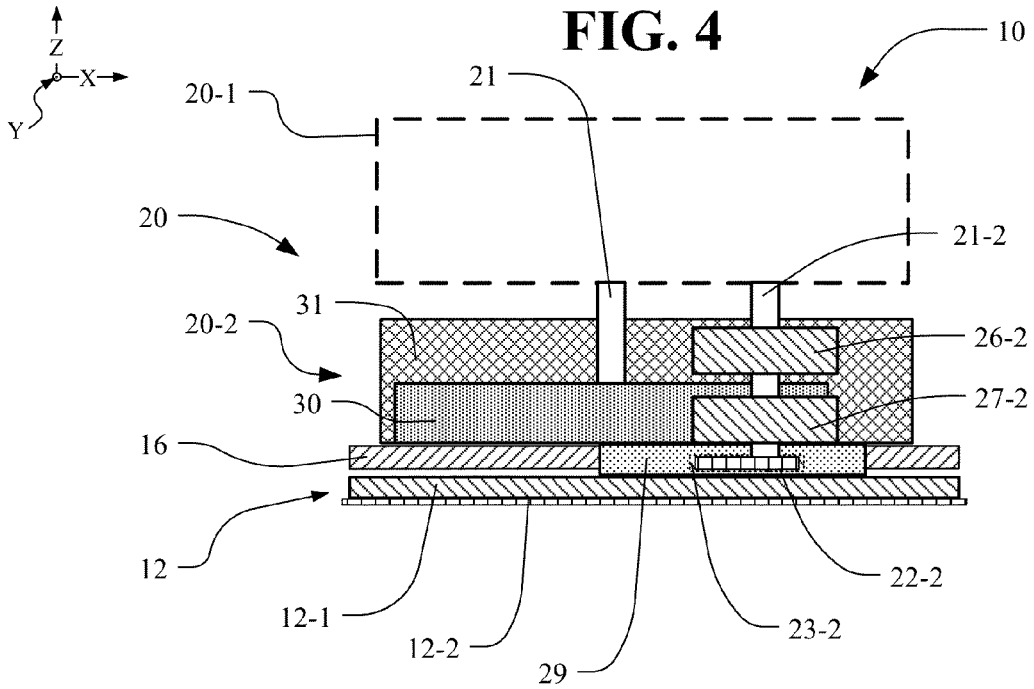
FIG. 4 depicts a side view of the drivers and the cleaning plate assembly of FIG. 3.

In FIG. 4, a side view of the drive assembly 10, the body plate 16 and the cleaning plate assembly 12 of FIG. 3 are shown. The drive assembly 10 includes a motor 30 and a transmission 20. The base 31 supports the motor 30 and the transmission 20. The transmission 20 includes a first transmission assembly part 20-1 and a second transmission assembly part 20-2. In FIG. 4, the first transmission assembly part 20-1 connects to the second transmission assembly part 20-2 through a motor drive shaft 21 and a second drive shaft 21-2. In the second transmission assembly part 20-2, a base 31 supports the motor 30 and the second drive shaft 21-2. The second drive shaft 21-2 is supported by second bearings 26-2 and 27-2 and connects to the second offset driver 22-2. A second bushing 23-2 in the eccentric drive member 29 engages the second offset driver 22-2. The transmission 20 operates to transfer the rotational motion of the drive shaft 21 to the drive shaft 21-2 and thereby to the offset driver 22-2. The offset driver 22-2 drives the cleaning plate assembly 12 with a vibrating motion.

Figure 5:
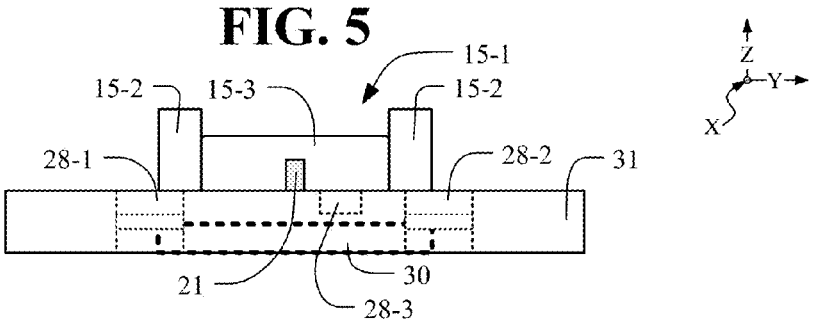
FIG. 5 depicts a front view of the motor and support for the surface treating machine of FIG. 1 and FIG. 2.

In FIG. 5, a front view is shown of the motor 30 and the support base 31 supporting the motor 30 for the surface treating machine 1 of FIG. 1 and FIG. 2. The support base 31 has openings 28-1, 28-2 and 28-3 for bearings. The support base 31 is rigidly attached to a handle assembly mount 15-1. The handle assembly mount 15-1 includes rigid end brackets 15-2 rigidly attached to base 31 and includes handle mount 15-3 that is rotatably attached to the rigid end brackets 15-2. The handle mount 15-3 engages the handle 15 of FIG. 1 and FIG. 2.

Figure 6:
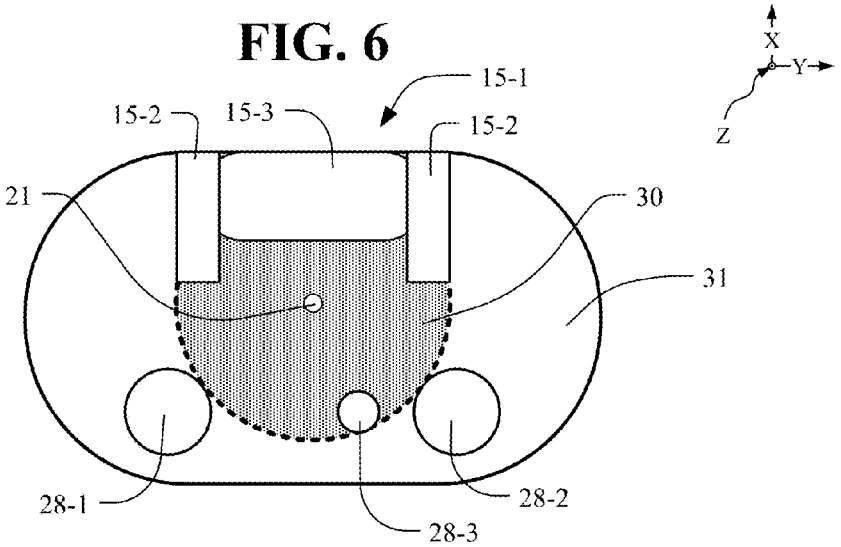
FIG. 6 depicts a top view of the motor and support of FIG. 5.

In FIG. 6, a top view of the motor 30 and support base 31 of the drive assembly 10 of FIG. 3 is shown with the axis of drive shaft 21 of drive motor 30 extending in the Z-axis direction away from the XY-plane and normal to the drawing page. The base 31 has holes 28-1, 28-2 and 28-3 for receiving the transmission shafts, 21-1, 21-2 and 21-3, see FIG. 3, and bearings, 26-1 and 27-1; 26-2 and 27-2; and 41-1 and 42-1, see FIG. 3. The support base 31 is rigidly attached to a handle assembly mount 15-1. The handle assembly mount 15-1 includes rigid end brackets 15-2 rigidly attached to base 31 and includes handle mount 15-3 that is rotatably attached to the rigid end brackets 15-2. The handle mount 15-3 engages the handle 15 of FIG. 1 and FIG. 2.

Figure 7:
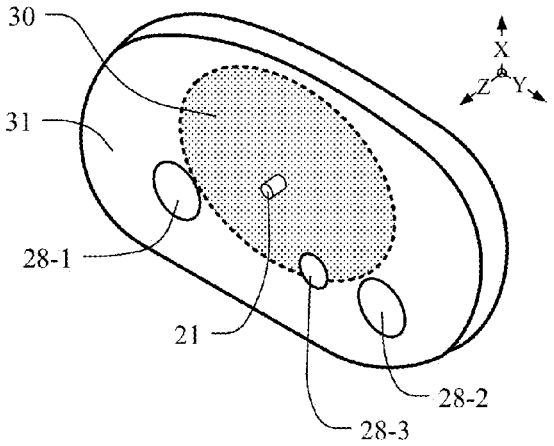
FIG. 7 depicts a perspective view of the motor and support of FIG. 5.

In FIG. 7, a perspective view is shown of the motor 30 and support base 31 of FIG. 6 without the handle assembly mount 15-1. The base 31 has holes 28-1, 28-2 and 28-3 for receiving the transmission shafts, 21-1, 21-2 and 21-3, see FIG. 3, and bearings, 26-1 and 27-1; 26-2 and 27-2; and 41-1 and 42-1, see FIG. 3.

Figure 8:
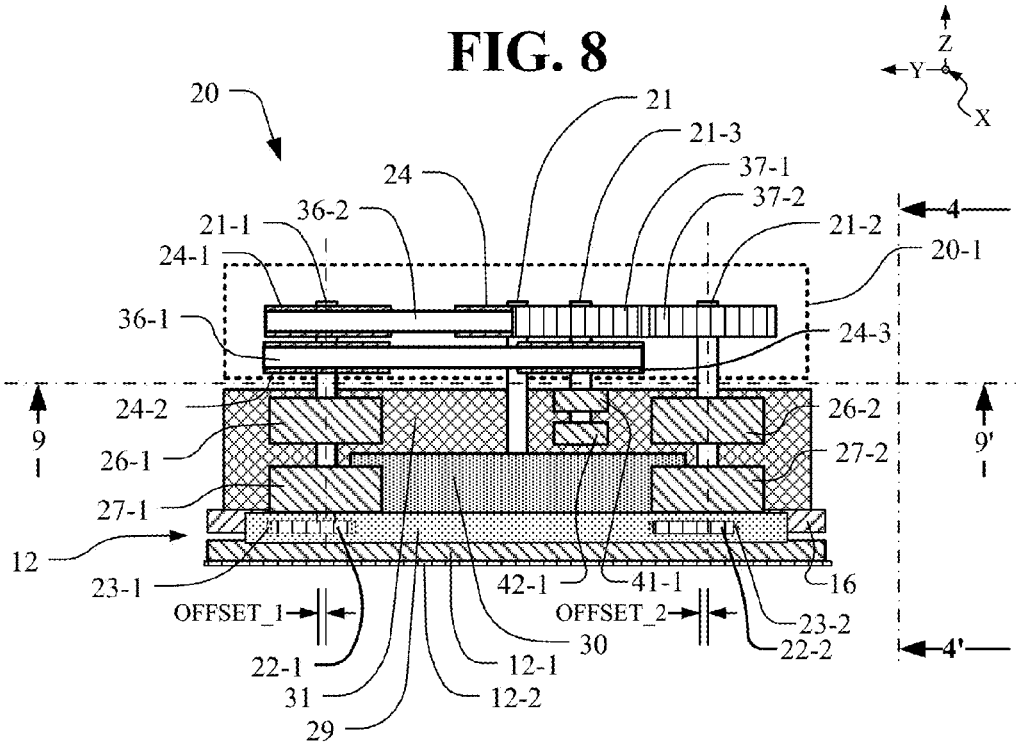
FIG. 8 depicts a front view of the gears, pulleys and belts that form a part of one embodiment of the transmission for the surface treating machine of FIG. 1 and FIG. 2.

In FIG. 8, a front view with further details of one embodiment of the drive assembly 10, the body plate 16 and the cleaning plate assembly 12 of FIG. 1 is shown. The drive assembly 10 includes a motor 30 and a transmission 20. The transmission 20 includes a first transmission assembly part 20-1 and a second transmission assembly part 20-2. The first transmission assembly part 20-1 connects to the second transmission assembly part 20-2 through a motor drive shaft 21, a first drive shaft 21-1, and a second drive shaft 21-2 and a third drive shaft 21-3. In the second transmission assembly part 20-2, a base 31 supports the motor 30 and the first drive shaft 21-1, the second drive shaft 21-2 and the third drive shaft 21-3.

The first drive shaft 21-1 is supported by first bearings 26-1 and 27-1 in the base 31 which connects to a first offset driver 22-1. A first bushing 23-1 in the eccentric drive member 29 engages the first offset driver 22-1. The second drive shaft 21-2 is supported by second bearings 26-2 and 27-2 in the base 31 which connects to a second offset driver 22-2. A second bushing 23-2 in eccentric driver 29 engages the second offset driver 22-2. The third drive shaft 21-3 is supported by third bearings 41-1 and 42-1 in the base 31.

The transmission first assembly 20-1 operates to transfer the rotational motion of the drive shaft 21 to the drive shafts 21-1 and 21-2 and thereby to the offset drivers 22-1 and 22-2. The transmission assembly 20-1 in one embodiment includes motor pulley 24 connected to the motor drive shaft 21, a first pulley 24-1 connected to a first drive shaft 21-1 and a second pulley 24-2 connected to the second drive shaft 21-2. A third pulley 24-3 is connected to the drive shaft 21-3. A gear 37-1 connects to the drive shaft 21-3. A gear 37-2 connects to the drive shaft 21-3. The gear 37-1 engages and in operation rotates the gear 37-2.

The pulleys 24, 24-1, 24-2 and 24-3 together with the gears 37-1 and 37-2, as part of the transmission 20, operate to transfer the rotational motion of the drive shaft 21 from motor 30 to the drive shafts 21-1 and 21-2. The motor pulley 24 is driven in the clockwise direction and drives pulley 24-1 and drive shaft 21-1 in the clockwise direction through belt 36-2. The pulley 24-2, attached to drive shaft 21-1, is driven in the clockwise direction and drives pulley 24-3 and gear 37-1 attached to drive shaft 21-3 in the clockwise direction through belt 36-1. The gear 37-1 attached to drive shaft 21-3 and driven in the clockwise direction engages gear 37-2 and turns gear 37-2 and drive shaft 21-2 in the counterclockwise direction. The pulleys 24-2 and 24-3 are of the same diameter and design so that the drive shafts 21-1 and 21-3 turn in the same direction and at the same speed. The gear 37-1 and the gear 37-2 are of the same diameter and design so that the drive shafts 21-3 and 21-2 turn at the same speed but rotate in opposite directions. Because the first offset driver 22-1 and the second offset driver 22-2 have offsets from the center lines of drive shafts 21-1 and 21-2, the eccentric drive member 29 oscillates within an opening in the body plate 16.

Figure 9:
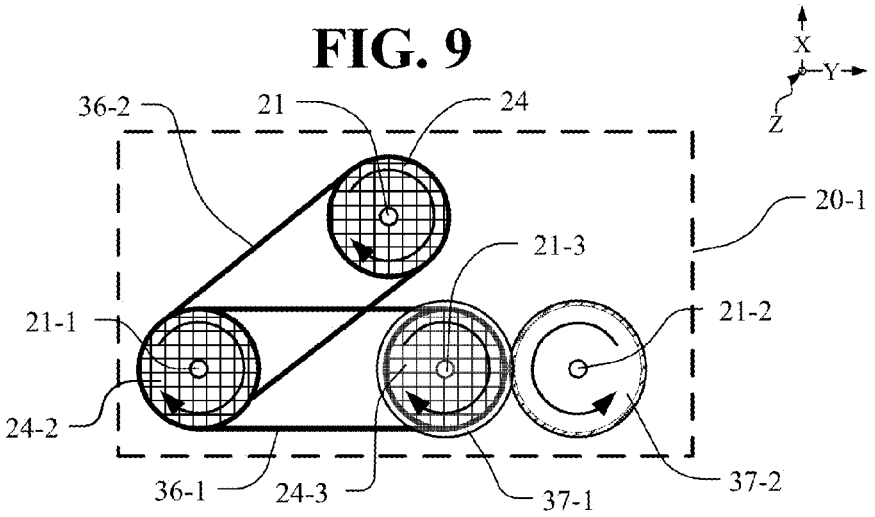
FIG. 9 depicts a top view of the gears, pulleys and belts of FIG. 8.

In FIG. 9, a bottom view is shown of the transmission first assembly 20-1 of FIG. 8 taken along the section line 9-9' in FIG. 8. The transmission first assembly 20-1 operates to transfer the rotational motion of the drive shaft 21 to the drive shafts 21-1 and 21-2. The transmission assembly 20-1 includes motor pulley 24 connected to the motor drive shaft 21, a first pulley 24-1, not shown in FIG. 9, see FIG. 8, connected to a first drive shaft 21-1 and a second pulley 24-2 connected to the first drive shaft 21-1. A third pulley 24-3 is connected to the drive shaft 21-3. A gear 37-1 also connects to the drive shaft 21-3. A gear 37-2 connects to the drive shaft 21-3. The gear 37-1 engages the gear 37-2. The pulleys 24-2 and 24-3 are of the same diameter and design so that the drive shafts 21-1 and 21-3 turn in the same direction and at the same speed. The gear 37-1 and the gear 37-2 are of the same diameter and design so that the drive shafts 21-3 and 21-2 turn at the same speeds but in the opposite directions.

Figure 10:
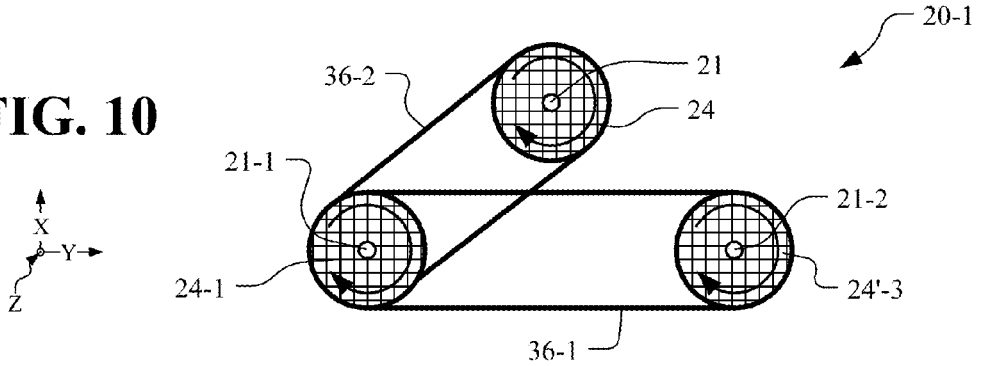
FIG. 10 depicts a top view of the pulleys and belts that form a part of an embodiment of the transmission of FIG. 3.

In FIG. 10, a top view is shown of the pulleys 24, 24-1, 26-1 (not shown) and 26-2 and belts 36-1 and 36-2 that form a part of another embodiment of the transmission first assembly 20-1 of FIG. 3. The transmission first assembly 20-1 operates to transfer the rotational motion of the drive shaft 21 to the drive shafts 21-1 and 21-2. The transmission assembly 20-1 includes motor pulley 24 connected to the motor drive shaft 21, a first pulley 24-1 connected to a first drive shaft 21-1 and a pulley 24'-3 connected to the second drive shaft 21-2. The pulley 24-2 (not shown) is below the pulley 24-1. The belt 36-2 connects between the pulley 24 and the pulley 24-1. The belt 36-1 connects between the pulley 24-2 (not shown) and the pulley 24'-3. The transmission first assembly 20-1 operates so that the drive shafts 21-3 and 21-2 turn at the same speed and in the same direction.

Figure 11:
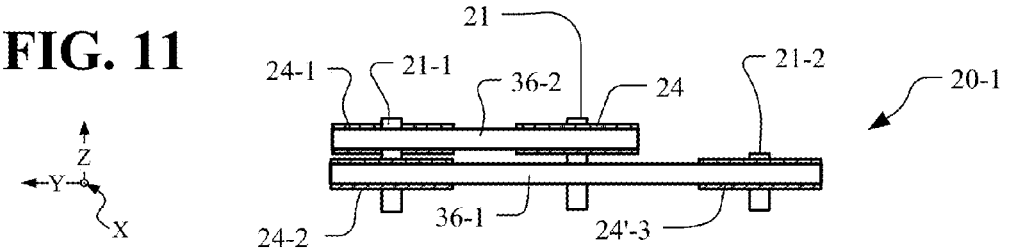
FIG. 11 depicts a front view of the pulleys and belts of FIG. 10.

In FIG. 11, a front view is shown of the pulleys and belts of FIG. 10. The transmission assembly 20-1 includes motor pulley 24 connected to the motor drive shaft 21 and a first pulley 24-1 connected to a first drive shaft 21-1. A pulley 24-2 connects to the first drive shaft 21-1 and a pulley 24'-3 connects to the second drive shaft 21-2. The belt 36-2 connects between the pulley 24 and the pulley 24-1. The belt 36-1 connects between the pulley 24-2 and the pulley 24'-3. The transmission first assembly 20-1 operates so that the drive shafts 21-1 and 21-2 turn at the same speed and in the same direction.

Figure 12:
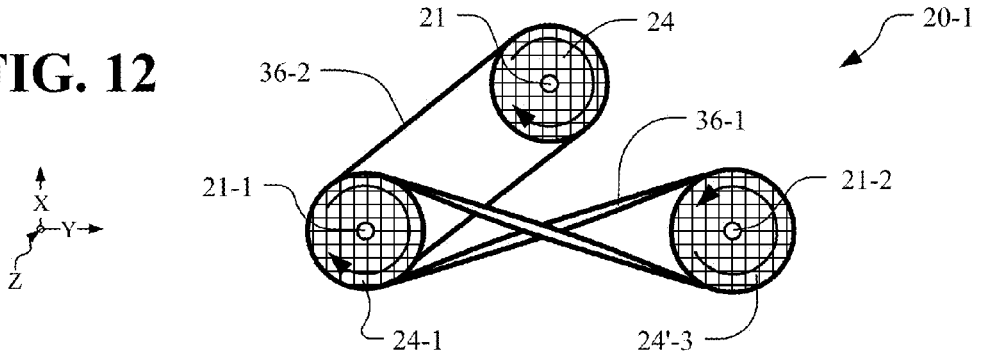
FIG. 12 depicts a top view of the pulleys and belts that form a part of another embodiment of the transmission of FIG. 3.

In FIG. 12, a top view is shown of the pulleys 24, 24-1, 26-1 (not shown) and 26-2 and the belts 36-1 and 36-2 that form a part of another embodiment of the transmission first assembly 20-1 of FIG. 3. The transmission first assembly 20-1 operates to transfer the rotational motion of the drive shaft 21 to the drive shafts 21-1 and 21-2. The transmission assembly 20-1 includes motor pulley 24 connected to the motor drive shaft 21, a first pulley 24-1 connected to a first drive shaft 21-1 and a pulley 24'-3 connected to the second drive shaft 21-2. The pulley 24-2 (not shown) is below the pulley 24-1 and first drive shaft 21-1. The belt 36-2 connects between the pulley 24 and the pulley 24-1. The belt 36-1 connects between the pulley 24-2 (not shown) and the pulley 24'-3. The belt 36-1 is twisted so that the transmission first assembly 20-1 operates with the drive shafts 21-3 and 21-2 turning at the same speed and in opposite directions.

Figure 13:
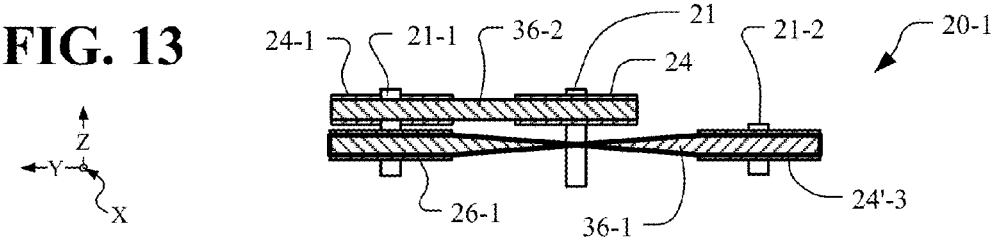
FIG. 13 depicts a front view of the pulleys and belts of FIG. 13.

In FIG. 13, a front view is shown of the pulleys and belts of FIG. 12. The transmission assembly 20-1 includes motor pulley 24 connected to the motor drive shaft 21 and a first pulley 24-1 connected to a first drive shaft 21-1. A pulley 24-2 connects to the first drive shaft 21-1 and a pulley 24'-3 connects to the second drive shaft 21-2. The belt 36-2 connects between the pulley 24 and the pulley 24-1. The belt 36-1 connects between the pulley 24-2 and the pulley 24'-3 and is twisted so that the drive shafts 21-3 and 21-2 turn at the same speed and in opposite directions.

In FIG. 14, an isometric view of the transmission of FIG. 12 is shown. The transmission assembly 20-1 includes motor pulley 24 connected to the motor drive shaft 21 and a first pulley 24-1 connected to a first drive shaft 21-1. The belt 36-2 connects between the pulley 24 and the pulley 24-1. A pulley 24-2 connects to the first drive shaft 21-1 and a pulley 24'-3 connects to the second drive shaft 21-2. The belt 36-1 connects between the pulley 24-2 and the pulley 24'-3 and is twisted so that the drive shafts 21-1 and 21-2 turn at the same speed and in opposite directions. The belt 36-1 is separated at the crossover location between the pulleys 26-1 and 26-2 by the belt separator 36-3. The belt separator 36-3 is made of metal, plastic or other smooth material that does not cause excessive wear of the belt 36-1.

In FIG. 15, an isometric view is shown of the reversing belt 36-1 and the belt spacer 36-2 in the transmission in FIG. 14.

Figure 16:
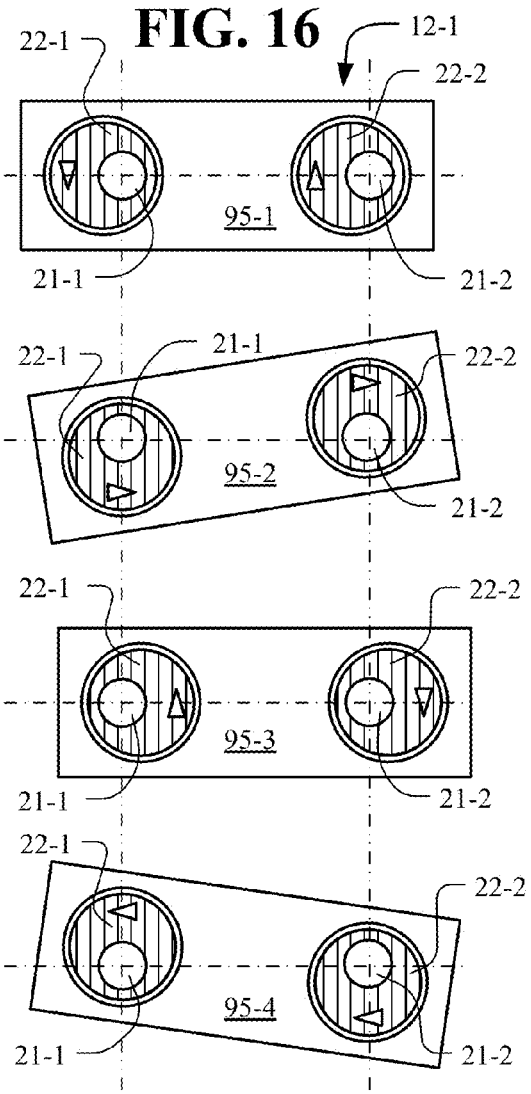
FIG. 16 depicts four different positions of the cleaning plate when the offset drivers are rotating in opposite directions.

In FIG. 16, shifted top views of four different positions are shown of the cleaning plate 12-1 according to the FIG. 8 and FIG. 12 transmissions. The four different positions are designated 95-1, 95-2, 95-3 and 95-4. In FIG. 16, the offset drivers 22-1 and 22-1 are rotating in opposite directions. With the offset driver of FIG. 16, the drive shafts 21-1 and 21-2 remain aligned. In embodiments such as FIG. 16 with the counter rotation of the offset drivers 22-1 and 22-2, the cleaning action is particularly suitable for hard surfaces such as wood floors and rugs with short piles and loops. A 2 millimeter offset has been found suitable for a machine having a minimum treatment dimension, M_D, of 7 inches.

Figure 17:
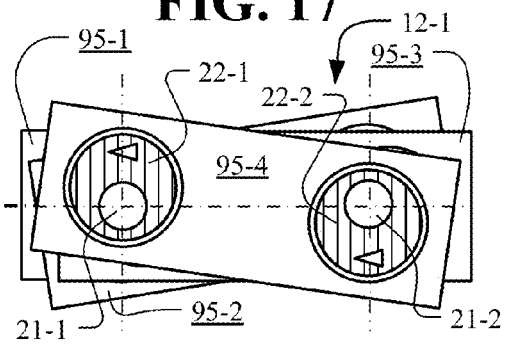
FIG. 17 depicts a top view of the four different positions of the cleaning plate when the offset drivers are rotating in opposite directions as shown in FIG. 16.

In FIG. 17 a non-shifted top view of the four different positions of FIG. 16 are shown for the cleaning plate 12-1. According to FIG. 17, the FIG. 8 and FIG. 12 transmissions drive through the four different typical positions designated 95-1, 95-2, 95-3 and 95-4.

Figure 18:
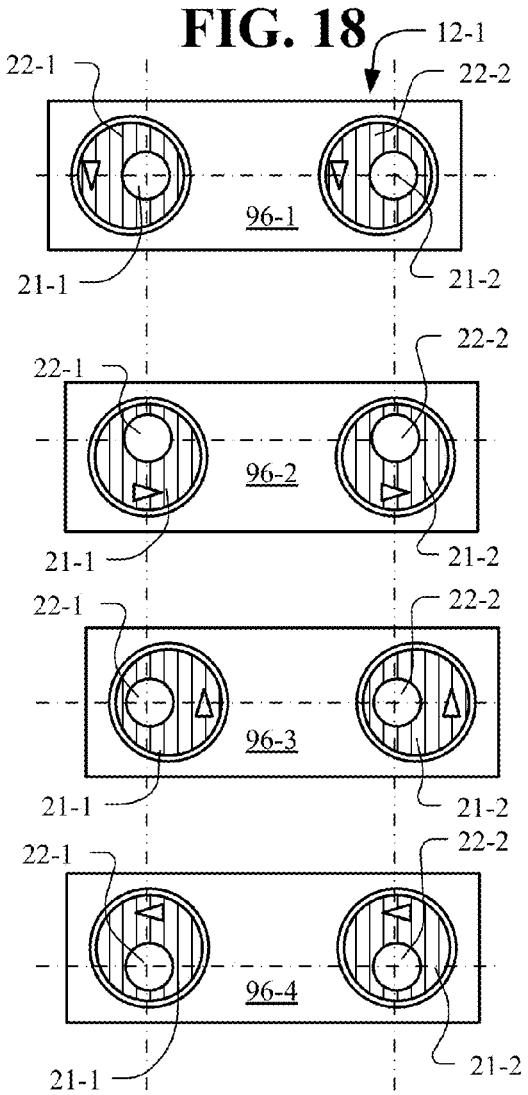
FIG. 18 depicts four different positions of the cleaning plate when the offset drivers are rotating in the same directions.

In FIG. 18, top views of four different positions are shown of the cleaning plate 12-1 using the FIG. 10 transmission. The four different positions are designated 96-1, 96-2, 96-3 and 96-4. In FIG. 18, the offset drivers 22-1 and 22-1 are rotating in the same direction. With the offset driver of FIG. 10, the drive shafts 21-1 and 21-2 remain aligned. In the embodiments such as FIG. 10, with the same direction rotation of the offset drivers 22-1 and 22-2, the cleaning action is particularly suitable for soft surfaces such as rugs with deep piles and loops. A 4 millimeter offset has been found suitable for a machine having a minimum treatment dimension, M_D, of 7 inches. For hard surfaces such as wood floors and rugs with short piles and loops, a 2 millimeter offset has been found suitable for a machine having a minimum treatment dimension, M_D, of 7 inches. In general, the first offset and the second offset are in a range from approximately 2 millimeters to 4 millimeters. However, the range of off-sets can be larger for machines having different treatment dimensions.

Figure 19:
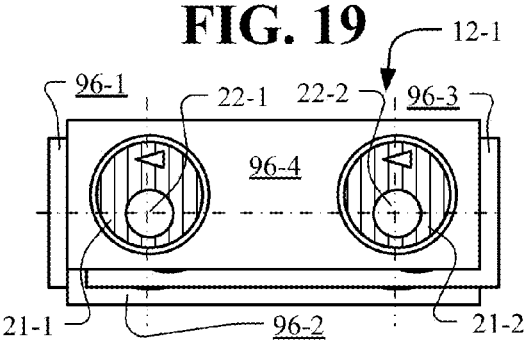
FIG. 19 depicts a top view of the four different positions of the cleaning plate when the offset drivers are rotating in the same direction as shown in FIG. 18.

In FIG. 19 a non-shifted top view of the four different positions of FIG. 18 are shown for the cleaning plate using the FIG. 10 transmission. The four different positions are designated 96-1, 96-2, 96-3 and 96-4.

Figure 20:
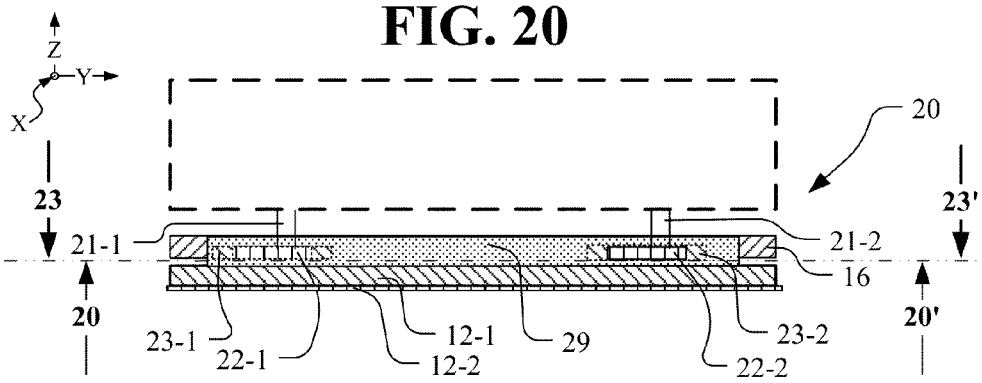
FIG. 20 depicts a front view of the cleaning plate assembly and the body plate of FIG. 3.

In FIG. 20, a front view of an embodiment of the cleaning plate assembly 12 and the body plate 16 of FIG. 3 is shown. The transmission 20 of FIG. 3 operates to transfer the rotational motion of the drive shaft 21 to the drive shafts 21-1 and 21-2 of FIG. 20 and thereby to the offset drivers 22-1 and 22-2 and the eccentric drive member 29. The eccentric drive member 29 is rigidly attached to and/or is formed as part of cleaning plate 12-1. The offset drivers 22-1 and 22-2 and the eccentric drive member 29 drive the cleaning plate 12-1 and cleaning pad 12-2 in a vibrating motion in the XY-plane by ±OFFSET_D, See FIG. 3. A first bushing 23-1 in the eccentric drive member 29 engages the first offset driver 22-1. A second bushing 23-2 in eccentric driver 29 engages the second offset driver 22-2. The eccentric drive member 29 extends through an opening in the rigid body plate 16.

Figure 21:
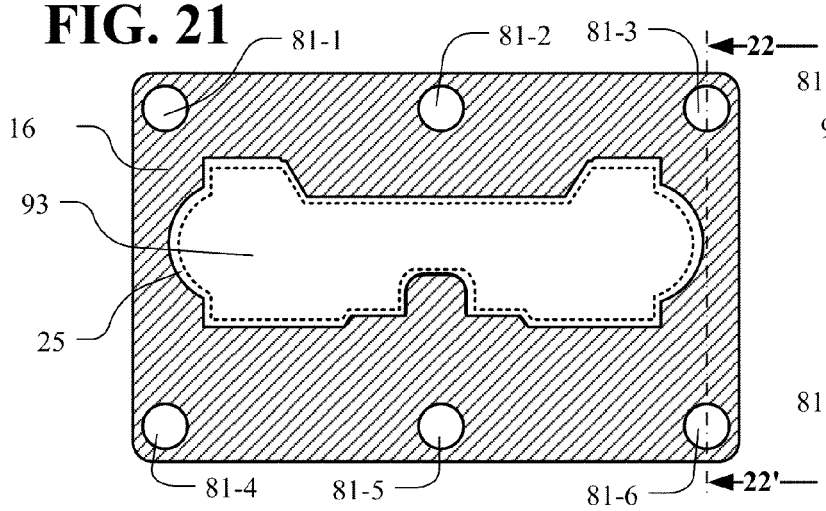
FIG. 21 depicts a bottom view of the body plate of FIG. 20 along the section line 20-20' of FIG. 20.

In FIG. 21, a bottom view of the body plate 16 of FIG. 20 is shown taken along the section line 20-20' of FIG. 20. The body plate 16 has pockets 81, including pockets 81-1, 81-2, . . . , 81-6, for receiving ball bearings. The body plate 16 includes an opening 93 for receiving the eccentric drive member 29. The opening 93 is larger than the size of the offset driver member 29 which is shown by a broken line in FIG. 21 with clearance offset 25 surrounding the broken line. The clearance offset permits the eccentric drive member 29 to vibrate within the opening 93 without contacting the body plate 16.

Figure 22:
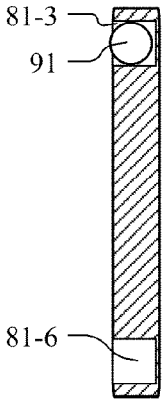
FIG. 22 depicts an end view of the body plate of FIG. 21.

In FIG. 22, an end view of the body plate 16 of FIG. 21 is shown taken along section line 22-22' of FIG. 21. The body plate 16 includes the deep recesses 81-3 and 81-6 for holding ball bearings, like ball bearing 91 shown as typical, in recess 81-3.

Figure 23:
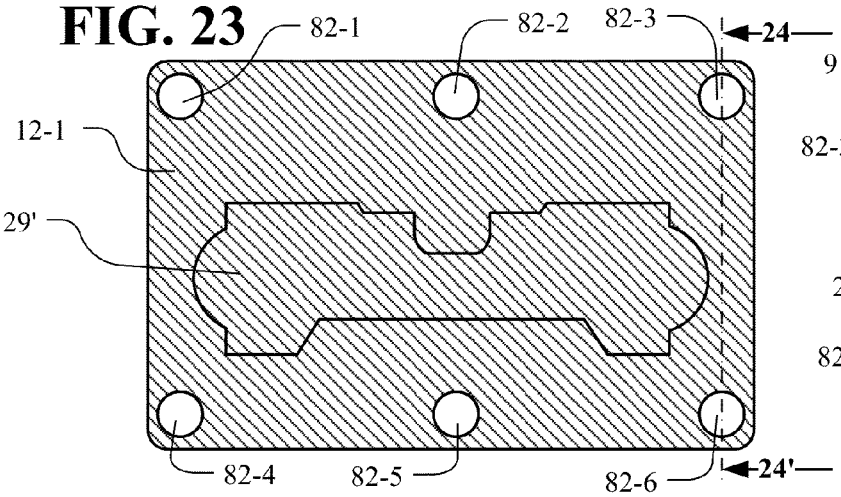
FIG. 23 depicts a top view of the cleaning plate of FIG. 20 along the section line 23-23' of FIG. 20.

In FIG. 23, a top view of the cleaning plate 12-1 of FIG. 20 is shown taken in the direction of the section line 23-23' of FIG. 20. The cleaning plate 12-1 includes a recess region 29' for receiving and attaching to the offset driver member 29 of FIG. 20. The vibrating cleaning plate 12-1 has pockets 82, including pockets 82-1, 82-2, . . . , 82-6, for receiving ball bearings which are in the pockets 81-1, 81-2, . . . , 81-6, respectively, of body plate 16 in FIG. 21.

Figure 24:
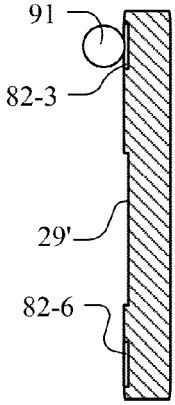
FIG. 24 depicts an end view of the cleaning plate of FIG. 23.

In FIG. 24, an end view of the cleaning plate 12-1 of FIG. 23 is shown taken along section line 24-24' of FIG. 23. The cleaning plate 12-1 includes the shallow recesses 82-3 and 82-6 for engaging ball bearings like ball bearing 91 in FIG.

22. The shallow recesses 82-3 and 82-6 are juxtaposed the deep recesses 81-3 and 81-6 when the body plate 16 is juxtaposed the cleaning plate 12-1. The ball bearings, like ball bearing 91, are seated in the deep recesses 81-3 and 81-6 and contact the shallow recesses 82-3 and 82-6. The diameters of the ball bearings are greater than the combined depths of the shallow recesses 82-3 and 82-6 and the deep recesses 81-3 and 81-6 so that the ball bearings hold the body plate 16 apart from the cleaning plate 12-1.

Figure 25:
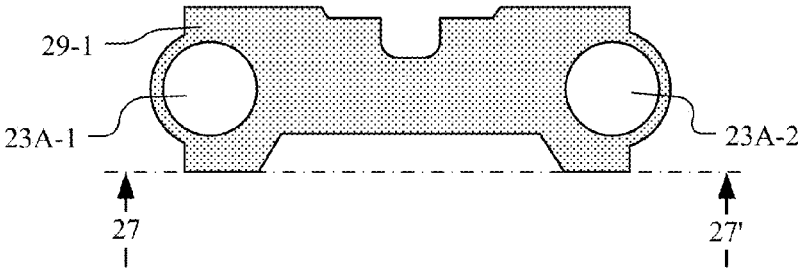
FIG. 25 depicts a top view of the top portion of the offset driver member that forms part of the drive assembly of FIG. 20.

In FIG. 25, a top view of the top portion 29-1 of the offset driver member 29, the offset guide that forms part of the drive assembly 10 of FIG. 20 is shown. The top portion 29-1 includes bearing openings 23A-1 and 23A-2 for receiving the offset drivers 22-1 and 22-2.

Figure 26:
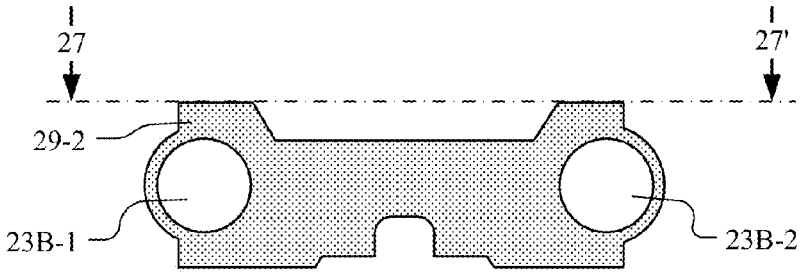
FIG. 26 depicts a top view of the bottom portion of the offset driver member that forms part of the drive assembly of FIG. 20.

In FIG. 26, a top view of the bottom portion of the offset driver member that forms part of the drive assembly of FIG. 20 is shown. The bottom portion 29-2 includes bearing openings 23B-1 and 23B-2 for receiving the offset drivers 22-1 and 22-2.

Figure 27:
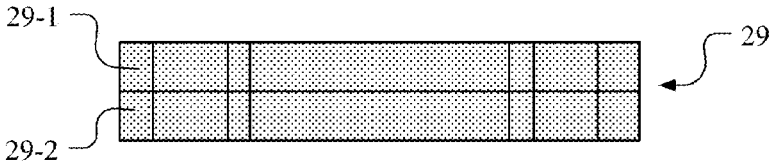
FIG. 27 depicts a front view of the top and bottom portions of the offset driver member that forms part of the drive assembly of FIG. 20.

In FIG. 27, a front view of the top portion 29-1 and the bottom portion 29-2 of the offset driver member 29 are positioned together to form offset driver member 29.

Figure 28:
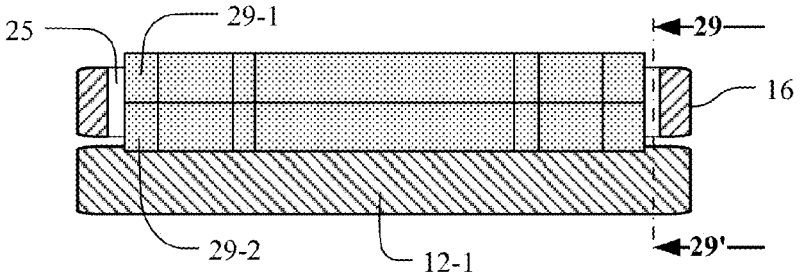
FIG. 28 depicts a front view of the offset driver member extending through the fixed body plate and attached to the cleaning plate.

In FIG. 28, a front view is shown of the offset driver member 29 extending through the fixed body plate 16 and is attached to the cleaning plate 12-1. The clearance distance 25 is between the body plate 16 and the offset driver member 29.

Figure 29:
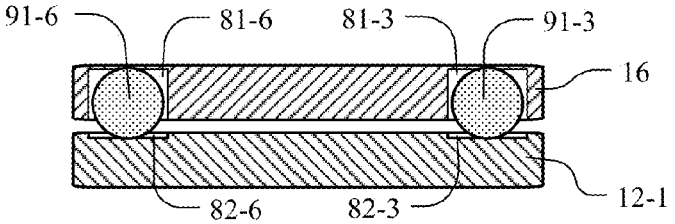
FIG. 29 depicts the fixed body plate adjacent the cleaning plate and held offset from the cleaning plate by rolling bearings.

In FIG. 29, the fixed body plate 16 is adjacent the cleaning plate 12-1 and is held offset from the cleaning plate 12-1 by rolling bearings, particularly ball bearings 91-3 and 91-6, shown as typical. The ball bearing 91-3 rolls in recess 81-3 in body plate 16 and in recess 82-3 in cleaning plate 12-1. The ball bearing 91-6 rolls in recess 81-6 in body plate 16 and in recess 82-6 in cleaning plate 12-1.

Figure 30:
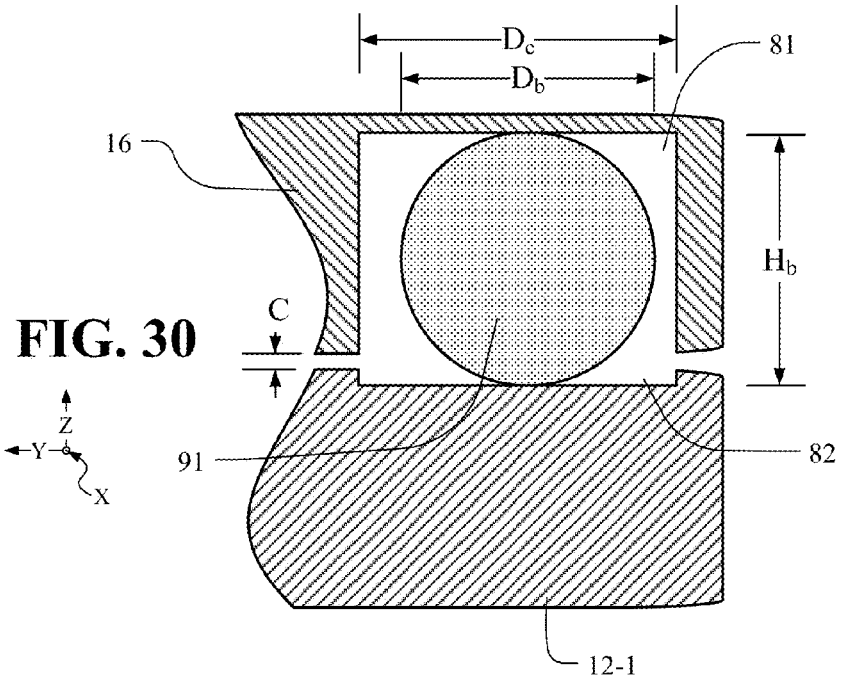
FIG. 30 depicts an expanded view of a portion of FIG. 29 with the fixed body plate adjacent the cleaning plate and held offset from the cleaning plate by one rolling ball bearing.

In FIG. 30, an expanded view is shown of a portion of FIG. 29 with the fixed body plate 16 adjacent the cleaning plate 12-1 and held offset from the cleaning plate 12-1 by one rolling bearing, ball bearing 91. Ball bearing 91 is typical of ball bearings 91-3 and 91-6 of FIG. 29. Ball bearing 91 has a diameter, $D_b$, large enough to maintain a gap of dimension C to separate body plate 16 and the cleaning plate 12-1. The diameter, $D_b$, equals a height, $H_b$, which is sufficient to maintain the gap C when the ball bearing is within the pockets 81 and 82. The diameter, $D_C$, of the pockets 81 and 82 is substantially greater than the diameter, $D_b$, to enable the cleaning plate 12-1 to oscillate in the XY plane relative to the fixed body plate 16 in the manner described in connection with FIG. 16 through FIG. 19.

Figure 31:
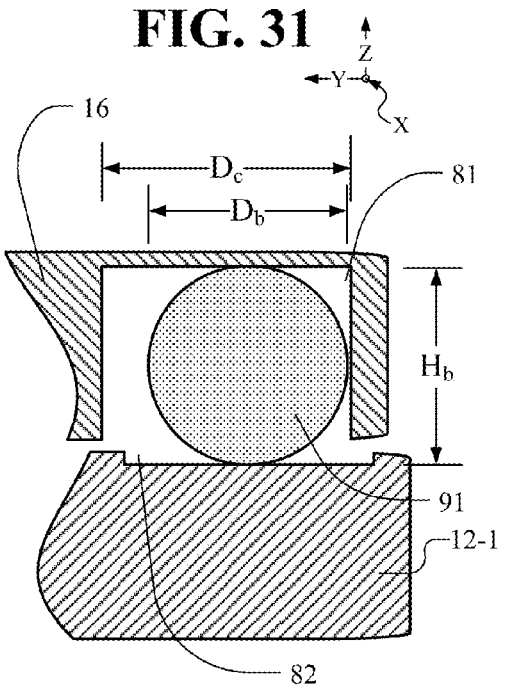
FIG. 31 depicts the view of FIG. 30 with the fixed body plate adjacent the cleaning plate and held offset from the cleaning plate by one rolling bearing rolled in one direction.

In FIG. 31, the expanded view of FIG. 30 is shown with the fixed body plate 16 adjacent the cleaning plate 12-1 and held offset from the cleaning plate 12-1 by ball bearing 91. The cleaning plate 12-1 has moved the maximum amount in one direction along the Y-axis. The ball bearing 91 has sufficient room in the pockets 81 and 82 to allow the movement of the cleaning plate 12-1 since the diameter of the cavity, $D_C$, is large enough to permit such movement.

Figure 32:
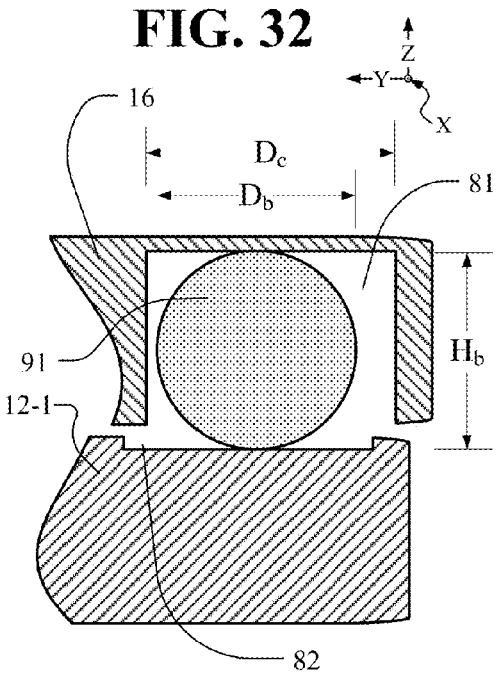
FIG. 32 depicts the expanded view of FIG. 30 with the fixed body plate adjacent the cleaning plate and held offset from the cleaning plate by one rolling bearing rolled in a direction opposite of the direction of FIG. 31.

In FIG. 32, the expanded view of FIG. 30 is shown with the fixed body plate 16 adjacent the cleaning plate 12-1 and held offset from the cleaning plate 12-1 by ball bearing 91. The cleaning plate 12-1 has moved the maximum amount in a direction along the Y-axis opposite the movement direction in FIG. 31. The ball bearing 91 has sufficient room in the pockets 81 and 82 to allow the movement of the cleaning plate 12-1 since the diameter of the cavity, $D_C$, is large enough to permit such movement.

Figure 33:
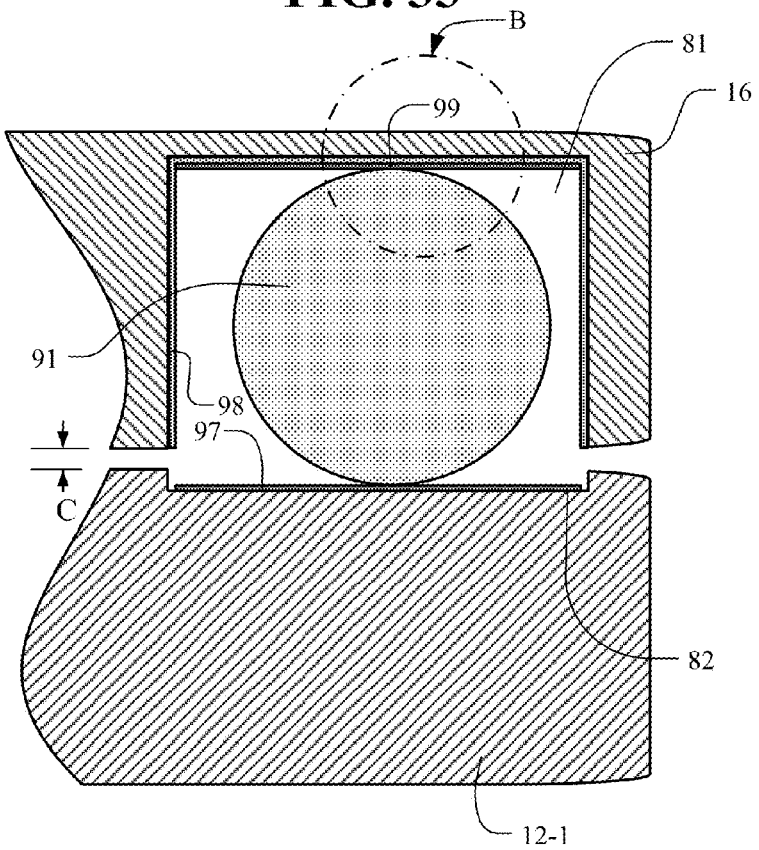
FIG. 33 depicts an expanded view of FIG. 30 showing details of the lining of the pockets for the rolling bearing.

In FIG. 33, an expanded view of FIG. 30 shows details of the wall linings 97, 98 and 99 of the pockets 81 and 82 for the rolling ball bearing 91. The wall linings 97, 98 and 99 are made of soft materials and prevent the ball bearing 91 from bouncing or banging and hence prevent loud noises. The soft materials suppress noise when the ball bearings, such as typical ball bearing 91, roll in the pockets, such as typical pockets 81 and 82, during movement of the cleaning plate 12-1.

Figure 34:
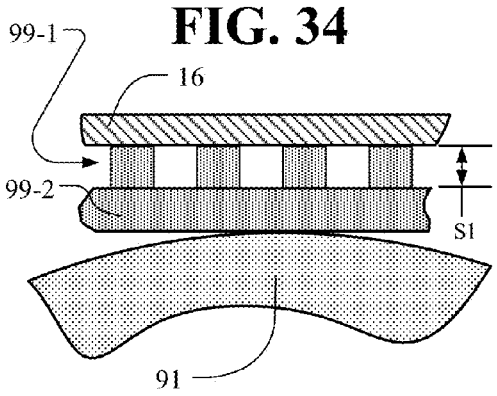
FIG. 34 depicts the alternate embodiment of an expanded view of FIG. 30 showing details of the lining of the pockets for the rolling bearing in an expanded state.

In FIG. 34, an expanded view is shown of one embodiment of a lining 99 region depicted in circle B in FIG. 33. In the FIG. 34 embodiment, the lining 99 is elastic in nature and is in the expanded state with a thickness, S1, filling all the space between the ball bearing 91 and the wall of the body plate 16.

Figure 35:
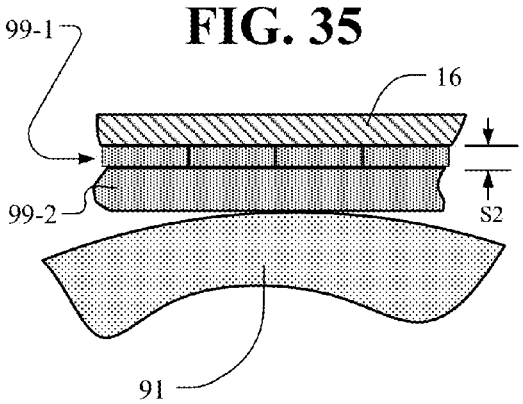
FIG. 35 depicts the alternate embodiment of an expanded view of FIG. 30 showing details of the lining of the pockets for the rolling bearing in a compressed state.

In FIG. 35, the embodiment of FIG. 34 is shown is in the compressed state with a thickness, S2, filling all the space between the ball bearing 91 and the wall of the body plate 16. The thickness, S2, is less than the thickness, S1. The difference between thickness, S2, and the thickness, S1, results from slight movements in the cleaning plate 12-1 caused by oscillations during operation.

In FIG. 33, FIGS. 34 and 35, the cavity 81 is typical of one or more of the pockets lined with a compressible soft material 99-1 whereby the ball bearings, such as typical ball bearing 91, are maintained in contact with both the body plate 16 and the cleaning plate 12-1.

In FIG. 21 through FIG. 35, it is apparent that the body plate 16 and the cleaning plate 12-1 each have pockets 81 and 82 for receiving the ball bearings whereby the ball bearings roll in the pockets during movement of the cleaning plate 12-1 in the oscillating pattern. It is further apparent that the body plate 16 and the cleaning plate 12-1 are rectangular in shape having longer sides and shorter sides. While rectangular is preferred in some embodiments, the body plate 16 and the cleaning plate 12-1 can have any convenient shape. Regardless of shape, two or more of the ball bearings are positioned near edges of the cleaning plate. In a rectangular embodiment, at least two of the ball bearings are positioned along one of the longer sides.

In FIG. 36, a view is shown of the cleaning plate 12-1 over a cleaning pad 12-2. The locations are shown of the motor drive shaft 21, the first drive shaft 21-1, the second drive shaft 21-2 and the third drive shaft 21-3. The drive shaft 21-1, by way of example, has a bending force applied by the cleaning plate 12-1. Those portions of the cleaning plate 12-1 that are farthest from shaft 21-1 operate with a longer moment arm and hence apply greater bending torque against the drive shaft. By way of example a moment arm, MA, is shown from drive shaft 21-1 to the far corner of cleaning plate 12-2.

In FIG. 37, a graphical representation is shown of a force diagram representing cleaning plate 12-1 and the torque applied to a drive shaft in the drive assembly. The drive shaft torque, $T_S$, is equal to the force, F, applied by the plate times the moment arm, MA. The greater the moment arm, MA, the greater the torque. The greater the force, F, the greater the torque. Torque against a drive shaft is undesirable since it tends to cause wear that shortens the life of the machine and tends to cause vibrations that make use of the machine uncomfortable. The addition of ball bearings described in connection with FIG. 21 through FIG. 35 substantially shortens the moment arms and hence substantially improves the life of the machines while improving the comfort of using the machines.

In FIG. 38, a graph of torque, T, versus force, F, is shown. When the ball bearings described in connection with FIG. 21 through FIG. 35 are not employed, the torque increases directly as a function of the force as shown by the solid line. However, when the ball bearings described in connection with FIG. 21 through FIG. 35 are employed, the torque increases to a low value and does not increase more as a function of increasing force as shown by the broken line.

Figure 39:
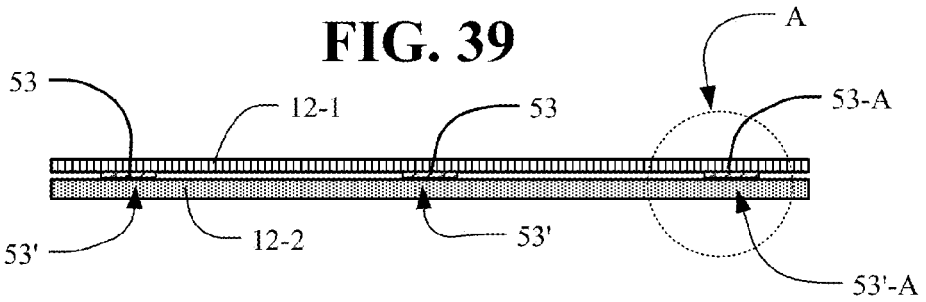
FIG. 39 depicts a cleaning pad affixed to the cleaning plate with fasteners.

In FIG. 39, a front view is shown of the cleaning plate 12-1 and the cleaning pad 12-2. The pad 12-2 is attached to the cleaning plate 12-1 by hook-and-loop fasteners where the hooks 53, including hooks 53-A, are attached to the cleaning plate 12-1 and the "loops", including loops 53'-A, are part of the pad 12-2.

Figure 40:
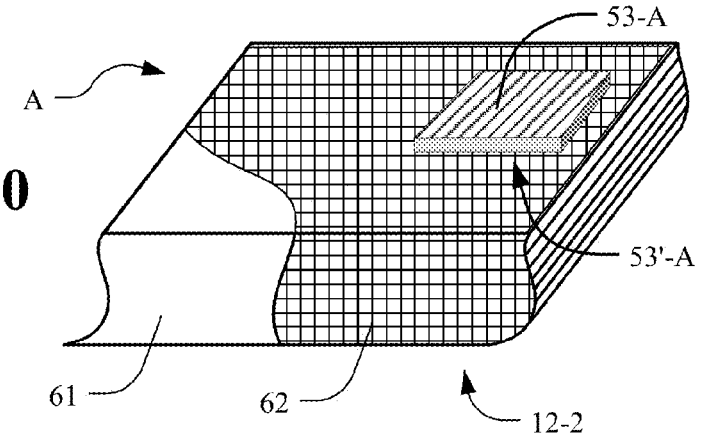
FIG. 40 depicts a perspective view of a portion of the cleaning pad of FIG. 40.

In FIG. 40, a perspective view is shown of a cutaway section A of the cleaning pad 12-2 of FIG. 39. The hook-and-loop fastener 53-A and 53'-A are typical of the hook-and-loop fasteners of FIG. 39. The loop portion 53'-A is fulfilled by the cover 62 that surrounds the cotton center 61. In addition to providing the "loop" function of the hook-and-loop fastening, the cover 62 is more abrasive then the cotton core 61. The more abrasive cover 62 functions when cleaning to dislodge more stubborn stains and particles. By way of contrast, the cotton center 61 is more absorbent and tends to absorb stains and particles dislodged by the abrasive cover 62 and by any liquid applied, such as water or cleaning solution.

Figure 41:
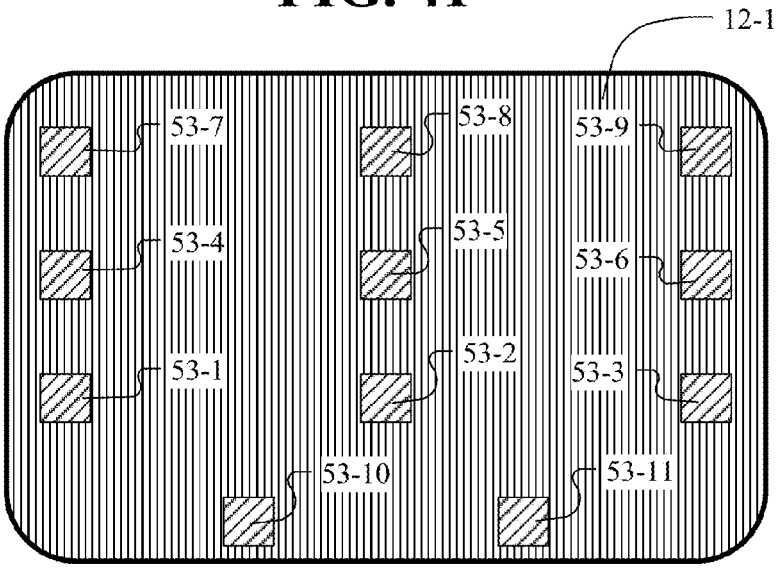
FIG. 41 depicts a bottom view of the cleaning plate and the attachment pads.

In FIG. 41, a bottom view is shown of the cleaning plate 12-1 and the attachment pads 53. The attachment pads 53-1, 53-2, . . . , 53-11 perform the "hook" function of the hook-and-loop fastening as described in connection with FIG. 40.

Figure 42:
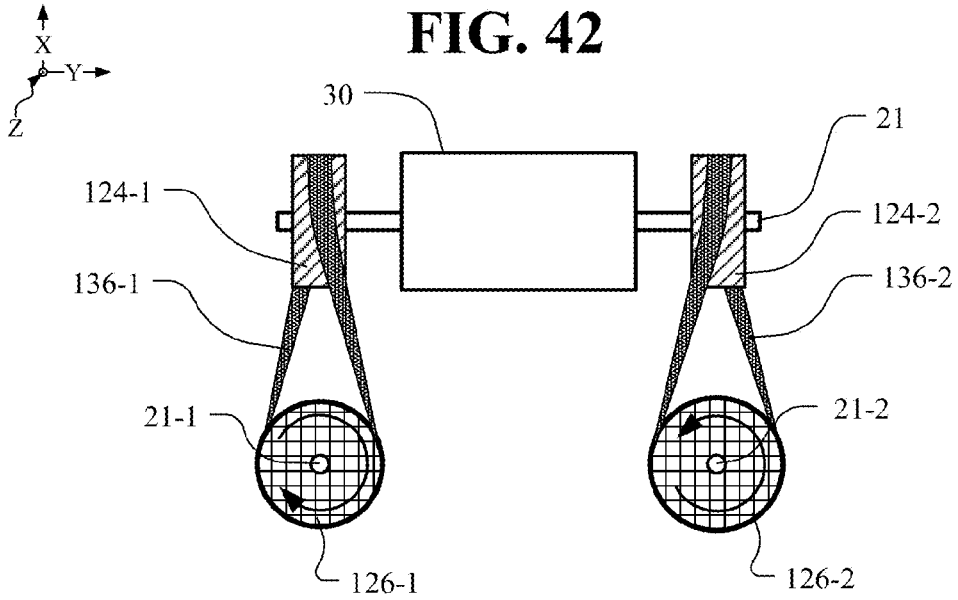
FIG. 42 depicts a top view of the pulleys and belts that form another embodiment for offset drivers.

In FIG. 42, a top view is shown of the pulleys 124-1, 124-2, 126-1 and 126-2 and belts 136-1 and 136-2 that form another embodiment of a transmission for connecting to offset drivers. The pulleys 124-1 and 124-2 are mounted on the motor drive shaft 21 which extends from either side of motor 30. The pulleys 124-1 and 124-2 rotate in the XZ-plane. The pulleys 126-1 and 126-2 are mounted on the drive shafts 21-1 and 21-2, respectively, and drive the eccentric drives. The pulleys 126-1 and 126-2 rotate in the XY-plane. The belt 136-1 connects between pulley 124-1 and pulley 126-1 and is twisted clockwise for turning pulley 126-1 and drive shaft 21-1 clockwise. The belt 136-2 connects between pulley 124-2 and pulley 126-2 and is twisted counter-clockwise for turning pulley 126-2 and drive shaft 21-2 counter-clockwise.

Figure 43:
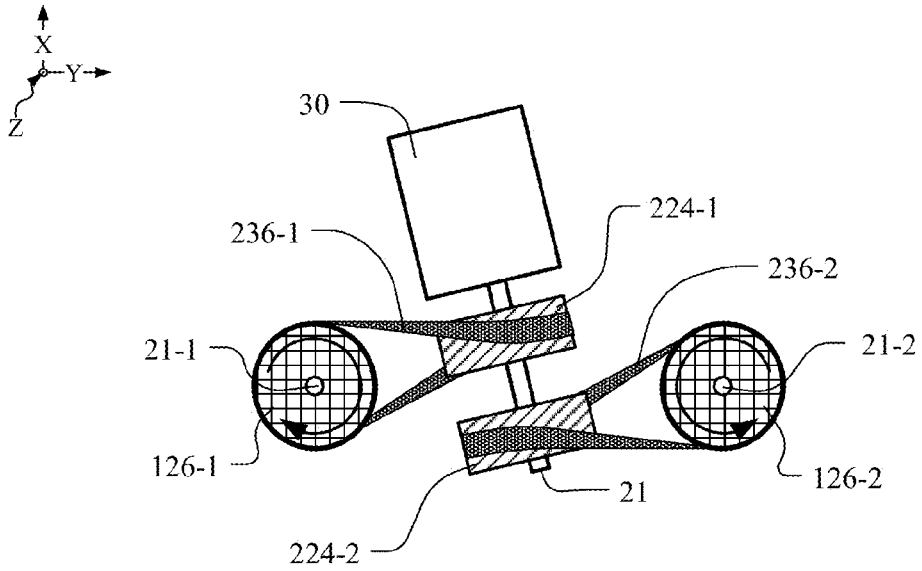
FIG. 43 depicts a top view of the pulleys and belts that form still another embodiment for offset drivers.

In FIG. 43, a top view is shown of the pulleys 224-1, 224-2, 126-1 and 126-2 and belts 236-1 and 236-2 that form another embodiment of a transmission for connecting to offset drivers. The pulleys 224-1 and 224-2 are mounted on the motor drive shaft 21 which extends only on one side of motor 30. The pulleys 224-1 and 224-2 rotate in the XZ-plane. The pulleys 126-1 and 126-2 are mounted on the drive shafts 21-1 and 21-2, respectively, and drive the eccentric drives. The pulleys 126-1 and 126-2 rotate in the XY-plane. The belt 236-1 connects between pulley 224-1 and pulley 126-1 and is twisted clockwise for turning pulley 126-1 and drive shaft 21-1 clockwise. The belt 236-2 connects between pulley 224-2 and pulley 126-2 and is twisted counter-clockwise for turning pulley 126-2 and drive shaft 21-2 counter-clockwise.

Figure 44:
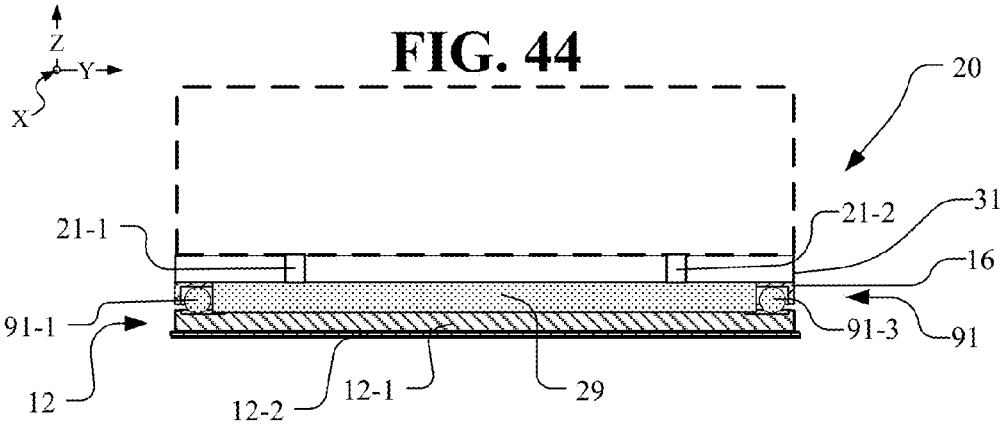
FIG. 44 depicts a front view of an embodiment of the cleaning plate assembly and the body plate like that of FIG. 20.

In FIG. 44, a front view of an embodiment of the cleaning plate assembly 12 and the body plate 16 like that of FIG. 20 is shown. The transmission 20 operates to transfer rotational motion to the drive shafts 21-1 and 21-2 and to the eccentric drive member 29. The eccentric drive member 29 is rigidly attached to cleaning plate 12-1. The eccentric drive member 29 drives the cleaning plate 12-1 and attached cleaning pad 12-2 in a vibrating motion in the XY-plane by ±OFFSET_D, See FIG. 3. The body plate 16 is rigidly attached to the base 31. The cleaning plate 12-1 and attached cleaning pad 12-2 move with an oscillation in the XY-plane relative to the body plate 16. The ball bearings 91, including ball bearings 91-1 and 91-3, keep the cleaning plate 12 separated from the body plate 16.

Figure 45:
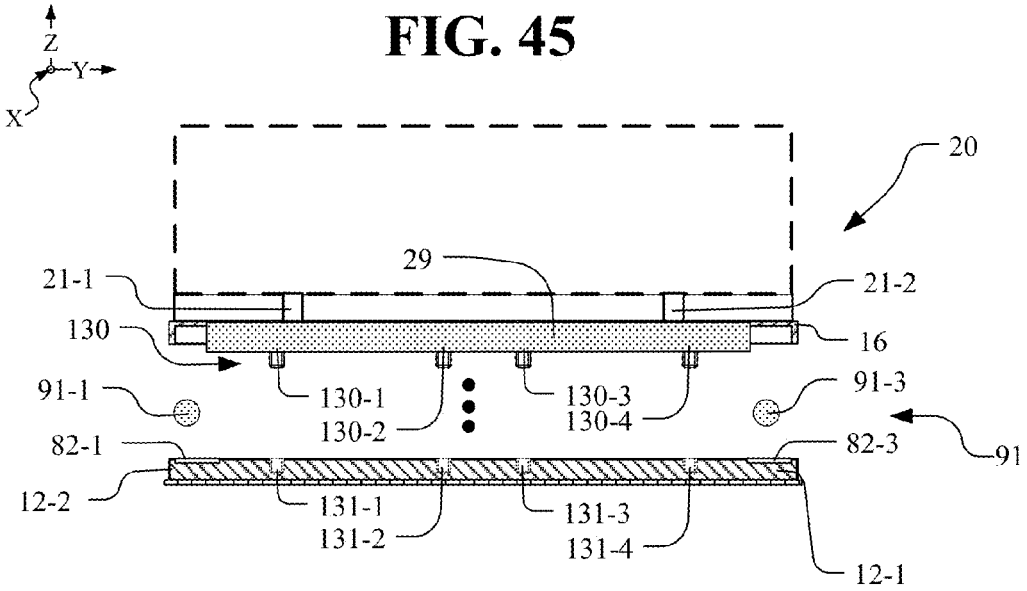
FIG. 45 depicts an exploded front view of an embodiment of the cleaning plate assembly and the body plate of FIG. 46.

In FIG. 45, an exploded front view of an embodiment of the cleaning plate assembly 12 and the body plate 16 of FIG. 44 is shown. The eccentric drive member 29 is rigidly attached to cleaning plate 12-1. The eccentric drive member 29 drives the cleaning plate 12-1 and attached cleaning pad 12-2 in a vibrating motion in the XY-plane by ±OFFSET_D, See FIG. 3. The eccentric drive member 29 attachment to cleaning plate 12-1 is accomplished using bolts 130 including bolts 130-1, 130-2, 130-3 and 130-4. The bolts 130 are oriented to engage the threaded holes 131, including holes 131-1, 131-2, 131-3 and 131-4, in the cleaning plate 12-1 when the cleaning plate 12-1 is brought in close proximity to the eccentric drive member 29. As the bolts 130 are screwed into the threaded holes 131, the ball bearings 91-1 and 91-2 are compressed between the cleaning plate 12-1 and the eccentric drive member 29. The ball bearings 91-1 and 91-3 keep the cleaning plate 12 separated from the body plate 16. The cleaning plate 12-1 while generally rigid in nature, still tends to bend slightly under the force of the tightening bolts 130. The bending draws the cleaning plate closer to and in contact with the eccentric drive member 29 in the center region while the ball bearings 91 prevent the bending around the edges. The shape of the bending is concave when viewed looking in the Z-axis direction at the bottom of the cleaning pad 12-2.

Figure 46:
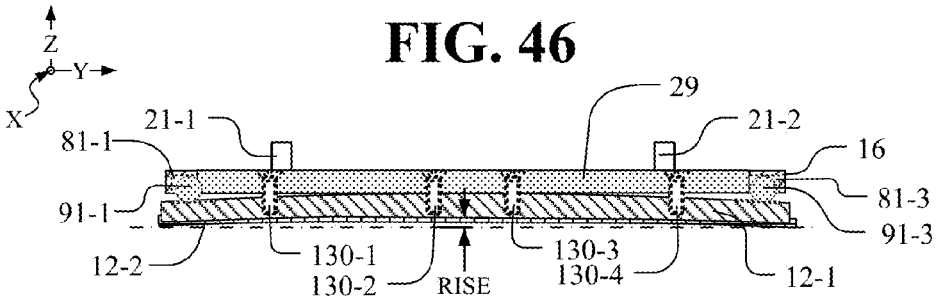
FIG. 46 depicts an assembled front view of an embodiment of the cleaning plate assembly and the body plate of FIG. 47.

In FIG. 46, an assembled front view of an embodiment of the cleaning plate assembly 12 and the body plate 16 of FIG. 45 is shown. The eccentric drive member 29 is rigidly attached to cleaning plate 12-1 by the bolts 130, including bolts 130-1, 130-2, 130-3 and 130-4. The bolts 130 are fully tightened. The concave arc of the cleaning plate 12-1 and cleaning pad 12-2 is shown by the RISE dimension measured from the reference line near the center to the bottom of the cleaning pad 12-2. At the edges near the ball bearings 91, including ball bearings 91-1 and 91-3, the cleaning pad 12-2 is in contact with the reference line and hence the concave shape of the cleaning plate 12-1 and cleaning pad 12-2 is formed.

Figure 47:
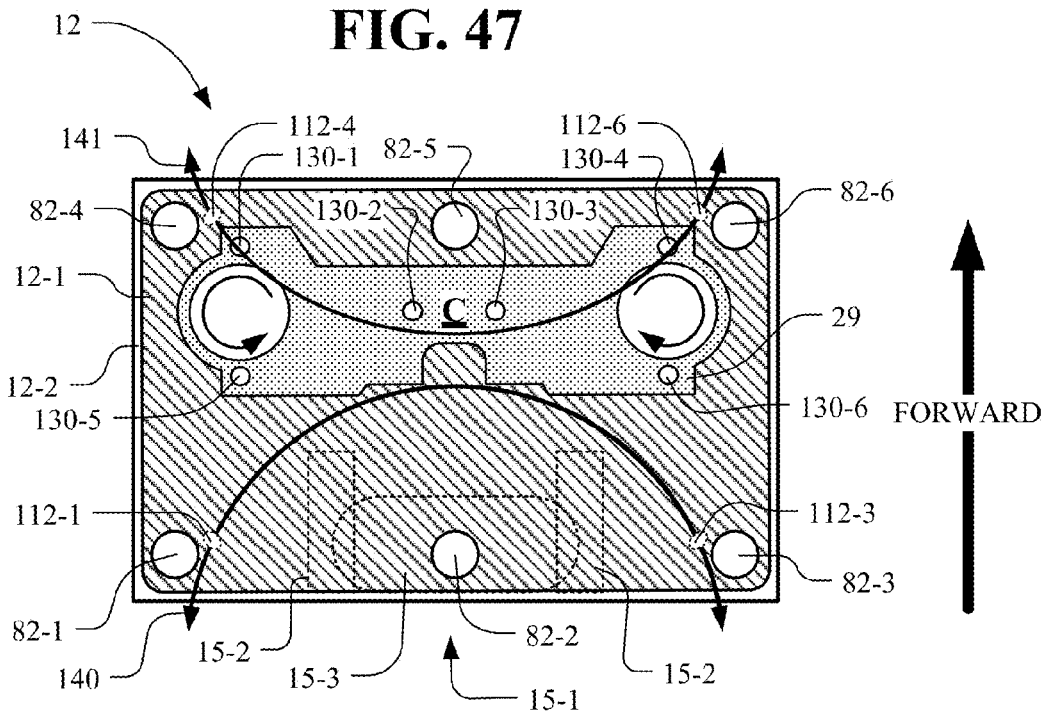
FIG. 47 depicts a top view of an embodiment of the cleaning plate assembly and eccentric drive member of FIG. 48.
Figure 48:
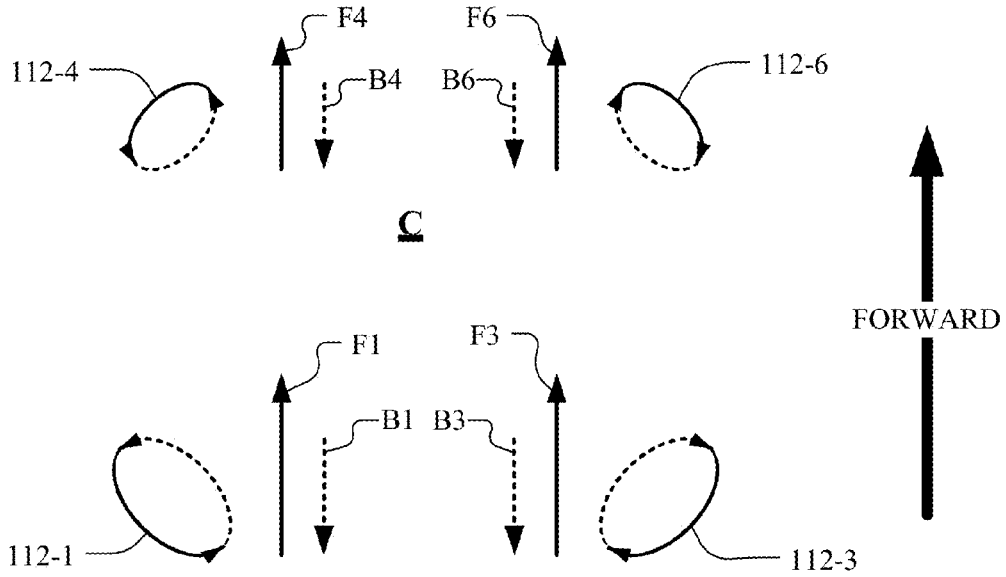
FIG. 48 depicts a diagram for explaining the forward drive of the geometry of the cleaning plate assembly and eccentric drive member of FIG. 47.

In FIG. 47, a top view is shown of an embodiment of the cleaning plate assembly 12 and eccentric drive member 29 of FIG. 46. The base 31 and the handle assembly 15-1 are shown with broken lines to show the orientation. The orientation in the FORWARD direction is indicated by the arrow. The eccentric drive member 29 is rigidly attached to cleaning plate 12-1 by the bolts 130, including bolts 130-1, 130-2, 130-3, 130-4, 130-5 and 130-6. The bolts 130 are fully tightened and the concave arc of the cleaning plate 12-1 and cleaning pad 12-2 as shown in FIG. 48 is shown schematically in FIG. 49 as the arrow 140. The entire cleaning plate assembly 12 has the concave shape as further represented by arrow 141. In operation as described in connection with FIG. 16 and FIG. 17, the entire cleaning plate assembly 12 has an oscillator motion. The vibrating cleaning plate 12-1 includes pockets 82-1, 82-2, . . . , 82-6 for receiving ball bearings which are in the pockets 81-1, 81-2, . . . , 81-6, respectively, of body plate 16, see FIG. 21 and FIG. 23. The ball bearings in the pockets 82-1 and 82-4 have a generally oval-shaped counter-clockwise rotation and the ball bearings in the pockets 82-3 and 82-6 have a generally oval-shaped clockwise rotation. Similarly, areas of the cleaning pads in the vicinity of the pockets 82-1 and 82-4 in the vicinity of the pockets 82-3 and 82-6 have generally the same counter-clockwise and clockwise rotations, respectively. The typical cleaning pad locations 112-1 and 112-4 in the vicinity of the pockets 82-1 and 82-4 have counter-clockwise rotations and the typical cleaning pad locations 112-3 and 112-6 in the vicinity of the pockets 82-3 and 82-6 have clockwise rotations. The cleaning pad locations 112-1 and 112-4 and the cleaning pad locations 112-3 and 112-6 are selected as typical since the entire cleaning pad 12-2 is a continuum of many such small locations.

In FIG. 48, a diagram is shown for explaining the forward drive of the geometry of the cleaning plate assembly 12 and eccentric drive member 29 of FIG. 47. The clockwise rotation of the cleaning pad locations 112-1 and 112-4 is depicted as having two parts, a solid part farthest away from the center of the concave shape and a broken-line part closer to center, C, of the concave shape. Because of the concave shape, the solid part tends to be pushed harder toward the floor or other surface being treated than the broken-line part. Accordingly, the forward force, F1, for the counter-clockwise oscillation 112-1 is greater than backward force, B1. The net force in the forward direction for the oscillation 112-1 is the difference, F1–B1. In a similar manner, the forward force, F4, for the counter-clockwise oscillation 112-4 is greater than backward force, B4. The net force in the forward direction for the counter-clockwise oscillation 112-4 is the difference, F4–B4. In a similar manner, the forward force, F3, for the clockwise oscillation 112-3 is greater than backward force, B3. The net force in the forward direction for the clockwise oscillation 112-3 is the difference, F3–B3. In a similar manner, the forward force, F6, for the clockwise oscillation 112-6 is greater than backward force, B6. The net force in the forward direction for the clockwise oscillation 112-6 is the difference, F6–B6.

When all the net forces as described in connection with FIG. 48 are summed, the result is a positive FORWARD drive force that helps propel the machine 1 of FIG. 1 and FIG. 2 forward rendering the machine easier to use. If the direction of rotation of the motor is reversed, then the driving direction is reversed to backward.

When a user is pushing the machine 1 of FIG. 1 and FIG. 2 in the forward direction, the resulting force on the handle 15, attached as shown in FIG. 47, exerts an increased force at the rear of the cleaning plate 12-1. This increased force tends to increase the forces of the F1 and F3 type and hence increase the FORWARD drive. Similarly, when a user is pulling the machine 1 of FIG. 1 and FIG. 2 in the backward direction, the resulting force on the handle 15, attached as shown in FIG. 47, exerts a decreased force at the rear of the cleaning plate 12-1 thereby reducing the FORWARD drive and making it easier to pull the machine backward.

While the invention has been particularly shown and described with reference to preferred embodiments thereof it will be understood by those skilled in the art that various changes in form and details may be made therein without departing from the scope of the invention.

The invention claimed is:

1. A machine for treating a surface lying in an XY-plane comprising, a body including a body plate having one or more body-plate pockets for receiving ball bearings, a drive assembly including a motor and a transmission, a cleaning plate assembly connected to the transmission to be driven in an oscillating pattern parallel to the XY-plane and relative to the body plate, the cleaning plate assembly having one or more cleaning-plate pockets aligned with the body-plate pockets, one or more ball bearings positioned between the body plate and the cleaning plate for separating the body plate and the cleaning plate whereby the ball bearings roll in the pockets during movement of the cleaning plate in the oscillating pattern.

2. The machine of claim 1 wherein two or more ball bearings are positioned near edges of the cleaning plate.

3. The machine of claim 1 wherein the pockets have side walls and the side walls are lined with soft material for suppressing noise when the ball bearings roll in the pockets during movement of the cleaning plate.

4. The machine of claim 1 wherein one or more of the pockets is lined with a compressible soft material whereby the ball bearings are maintained in contact with both the body plate and the cleaning plate.

5. The machine of claim 1 wherein the body plate and the cleaning plate are rectangular in shape having longer sides and shorter sides and wherein two of the one or more ball bearings are positioned along one of the longer sides.

6. A machine for treating a surface lying in an XY-plane comprising, a body including a body plate, the body plate having body-plate pockets, a drive assembly including a motor and a transmission, a cleaning plate assembly connected to the transmission to be driven in an oscillating pattern parallel to the XY-plane and relative to the body plate, the cleaning plate having cleaning-plate pockets aligned with the body-plate pockets, one or more ball bearings positioned between the body plate and the cleaning plate and engaging the cleaning-plate pockets and the body-plate pockets for separating the body plate and the cleaning plate whereby the ball bearings roll in the pockets during movement of the cleaning plate in the oscillating pattern.

7. A machine for treating a surface lying in an XY-plane comprising, a body including a body plate, the body plate having four body-plate pockets, a drive assembly including a motor and a transmission, a cleaning plate assembly connected to the transmission to be driven in an oscillating pattern parallel to the XY-plane and relative to the body plate, the cleaning plate having four cleaning-plate pockets aligned with the four body-plate pockets, four ball bearings positioned between the body plate and the cleaning plate and engaging the cleaning-plate pockets and the body-plate pockets for separating the body plate and the cleaning plate whereby the ball bearings roll in the pockets during movement of the cleaning plate in the oscillating pattern.

8. The machine of claim 7 wherein the ball bearings are positioned near edges of the cleaning plate.

9. The machine of claim 7 wherein the pockets have side walls and the side walls are lined with soft material for suppressing noise when the ball bearings roll in the pockets during movement of the cleaning plate.

10. The machine of claim 7 wherein the pockets are lined with compressible soft materials whereby the ball bearings are maintained in contact with both the body plate and the cleaning plate.

* * * * *